US008898017B2

(12) United States Patent
Kragas et al.

(10) Patent No.: US 8,898,017 B2
(45) Date of Patent: Nov. 25, 2014

(54) AUTOMATED HYDROCARBON RESERVOIR PRESSURE ESTIMATION

(75) Inventors: Tor Kristian Kragas, Warrenville, IL (US); John Foot, Aberdeenshire (GB); Hugh Richard Rees, Aberdeenshire (GB)

(73) Assignees: BP Corporation North America Inc., Houston, TX (US); BP Exploration Operating Company Limited, Middlesex (GB)

( * ) Notice: Subject to any disclaimer, the term of this patent is extended or adjusted under 35 U.S.C. 154(b) by 374 days.

(21) Appl. No.: 12/435,564

(22) Filed: May 5, 2009

(65) Prior Publication Data

US 2009/0276156 A1 Nov. 5, 2009

Related U.S. Application Data

(60) Provisional application No. 61/050,537, filed on May 5, 2008.

(51) Int. Cl.

| | |
|---|---|
| ***G01V 9/00*** | (2006.01) |
| ***E21B 43/12*** | (2006.01) |
| ***E21B 49/00*** | (2006.01) |
| ***E21B 49/08*** | (2006.01) |

(52) U.S. Cl.

CPC ..... *E21B 49/008* (2013.01); *E21B 43/12* (2013.01); *E21B 49/087* (2013.01)

USPC ..... 702/11

(58) Field of Classification Search

CPC ..... E21B 47/06; E21B 49/087

USPC ..... 702/6, 9, 11; 703/10

See application file for complete search history.

(56) References Cited

U.S. PATENT DOCUMENTS 5,303,582 A * 4/1994 Miska ..... 73/152.21
5,305,209 A * 4/1994 Stein et al. ..... 702/13

(Continued)

FOREIGN PATENT DOCUMENTS

WO 02/061239 A1 8/2002

OTHER PUBLICATIONS

Bourdet et al., Use of Pressure Derivative in Well Test Interpretation, SPE Formation Evaluation, Jun. 1989, pp. 293-302.*

Ehlig-Economides, Use of the Pressure Derivative for Diagnosing Pressure-Transient Bhavior, Journal of Petroleum Technology, Oct. 1988, pp. 1280-1282.*

Deruyck et al., "Testing Design and Analysis", Apr. 1992, Schlumberger, Oilfield Review 28-45.*

(Continued)

*Primary Examiner* — Jonathan C Teixeira Moffat
*Assistant Examiner* — Regis Betsch

(57) ABSTRACT

A method and system for estimating reservoir pressure in a hydrocarbon reservoir from downhole pressure measurements of producing wells is disclosed. Pressure measurements are obtained from wells in the production field over time, and communicated to a server that applies the pressure measurements for a well to a model of that well. The server operates the model using the pressure measurements to determine an operating mode of the well, such as producing or shut-in. Upon detection of a change in operating mode indicative of an abrupt change in flow at the well, such as corresponding to a shut-in event, additional downhole pressure measurement data is acquired until a steady-state condition is reached. The pressure measurements are used to determine a reservoir pressure, which is transmitted to a responsible reservoir engineer or other user. Modification of the determined reservoir pressure value by the user can be received, and the stored reservoir pressure and well model are updated accordingly.

37 Claims, 13 Drawing Sheets

(56) References Cited

U.S. PATENT DOCUMENTS

| | | | | |
|---|---|---|---|---|
| 5,803,167 | A * | 9/1998 | Bussear et al. | 166/65.1 |
| 5,934,371 | A * | 8/1999 | Bussear et al. | 166/53 |
| 5,975,204 | A * | 11/1999 | Tubel et al. | 166/250.15 |
| 6,236,894 | B1 * | 5/2001 | Stoisits et al. | 700/28 |
| 6,980,940 | B1 * | 12/2005 | Gurpinar et al. | 703/10 |
| 2005/0114031 | A1 | 5/2005 | Thambynayagam et al. | |
| 2005/0269079 | A1 * | 12/2005 | Franklin | 166/250.07 |
| 2005/0270903 | A1 * | 12/2005 | Ramakrishnan et al. | 367/40 |
| 2006/0157242 | A1 * | 7/2006 | Graham et al. | 166/268 |
| 2009/0037113 | A1 * | 2/2009 | Akram et al. | 702/12 |
| 2009/0276100 | A1 * | 11/2009 | Malki et al. | 700/282 |
| 2009/0292516 | A1 * | 11/2009 | Searles et al. | 703/10 |

OTHER PUBLICATIONS

Olsen, et al. "Experience From the Use of Automatic Well-Test Analysis," Annual Technical Conference and Exhibition, San Antonio, Texas, Sep. 24-27, 2006, SPE 102920, Society of Petroleum Engineers, pp. 1-14.

PCT International Search Report and Written Opinion dated Mar. 8, 2010 for International Application No. PCT/US2009/042874.

Well Test Solutions, Inc., Basic Surveillance: Using Pressure—Transient Data to Monitor Well & Reservoir Performance. http:/www.welltestsolutions.com/BasicSurv.pps, Sep. 9, 2011.

Roland N. Horne, Modern Well Test Analysis: A Computer-Aided Approach, Petroway Inc., Second Edition, May 1995, Palo Alto, CA, 257 pages.

* cited by examiner

AUTOMATED HYDROCARBON RESERVOIR PRESSURE ESTIMATION

CROSS-REFERENCE TO RELATED APPLICATIONS

This application claims priority, under 35 U.S.C. §119(e), to U.S. provisional patent application No. 61/050,537 filed on May 5, 2008, incorporated herein by this reference. This application is also related to U.S. patent application Ser. No. 12/035,209, filed Feb. 21, 2008, commonly assigned herewith and incorporated herein by this reference.

STATEMENT REGARDING FEDERALLY SPONSORED RESEARCH OR DEVELOPMENT

Not applicable.

BACKGROUND OF THE INVENTION

This invention is in the field of oil and natural gas production, and is more specifically directed to reservoir management and well management in such production.

Current economic factors in the oil and gas industry have raised the stakes for the optimization of hydrocarbon production. On one side of the equation, the market prices of oil and natural gas have reached new highs, by historical standards. However, the costs of drilling of new wells and operating existing wells are also high by historical standards, because of the extreme depths to which new producing wells must be drilled, because of the increased costs of the technology utilized, and because of other physical barriers to exploiting reservoirs. These higher economic stakes require production operators to devote substantial resources toward gathering and analyzing measurements from existing hydrocarbon wells and reservoirs in the management of production fields and of individual wells within a given field.

For example, the optimization of production from a given field or reservoir involves decisions regarding the number and placement of wells, including whether to add or shut-in wells. Secondary and tertiary recovery operations, for example involving the injection of water or gas into the reservoir, require decisions regarding whether to initiate or cease such operations, and also how many wells are to serve as injection wells and their locations in the field. Some wells may require well treatment, such as fracturing of the wellbore if drilling and production activity has packed the wellbore surface sufficiently to slow or stop production. In some cases, production may be improved by shutting-in one or more wells; in other situations, a well may have to be shut-in for an extended period of time, in which case optimization of production may require a reconfiguration of the production field. As evident from these examples, the optimization of a production field is a complex problem, involving many variables and presenting many choices.

The complexity of this problem is exacerbated by the scale of modern large oil and gas production fields, which often include hundreds of wells and a complex network of surface lines that interconnect these wells with centralized transportation or processing facilities. These activities and operations are made significantly more complex by variations in well maturity over a large number of wells in the production field, in combination with finite secondary and tertiary recovery resources. As such, the decisions for optimum production and economic return become extremely complex, especially for complex fields. Additionally, there may be added challenges in the later life operation of the production field. In addition, as mentioned above, the economic stakes are high.

In recent years, advances have been made in improving the measurement and analysis of parameters involved in oil and gas production, with the goal of improving production decisions. For example, surface pressure gauges and flow meters deployed at the wellhead. Further, the surface lines interconnecting wellheads with centralized processing facilities, are now commonly monitored. These gauges and meters are also used with separating equipment, to measure the flow of each phase (oil, gas, water). Because these sensors can provide data on virtually a continuous basis, an overwhelming quantity of measurement data can rapidly be obtained from a modern complex production field. This vast amount of data, along with the complexity of the production field, and the difficulty in deriving a manageable model of the reservoir and the production field, add up to create a very complex and difficult optimization problem for the reservoir engineering staff.

One approach to managing production optimization for a complex production field is described in U.S. Pat. No. 6,236,894, incorporated herein by this reference. This approach uses an adaptive network, specifically involving genetic algorithms, to derive well operation parameters for optimizing production. The U.S. Pat. No. 6,236,894 illustrates the nature and complexity some aspects and problems associated with optimization of a modern production field.

By way of further background, it is known that incremental fluid flow from a well is approximately proportional to the difference in pressure between the reservoir pressure and the pressure in the production tubing at the reservoir depth. This pressure may be generally considered as the sum of the production header pressure at the wellhead plus the combination of the static head within the well and the frictional losses along the wellbore to the surface. This important relationship between reservoir pressure and flow rate is the basis of conventional well testing, which is useful in both analyzing the performance of a specific well, and also in determining reservoir-wide parameters, such as reservoir pressure.

Typically, pressure transient well tests involve the characterization of the bottomhole pressure relative to the flow rate, to derive such parameters as reservoir pressure, permeability of the surrounding reservoir formation, and the "skin" of the borehole. These parameters are useful in understanding the performance of a given well. These pressure transient tests can be classified as "shut-in" (or "build-up") tests, on one hand, or as "drawdown" tests, on the other. In the shut-in test, the downhole pressure is measured over time, beginning prior to shutting-in the well and continuing after shut-in. The reservoir pressure is determined from the measurement of the downhole pressure at such time as the time-rate-of-change of pressure stabilizes, following the shut-in event. Conversely, a well can be characterized in a drawdown test, which is the opposite of a shut-in test in that the flow is measured before, during, and after a dramatic increase in well flow, such as opening the choke from a shut-in condition.

It has been observed that, for determination of reservoir pressure from these conventional pressure transient tests, the duration of the shut-in event required to achieve the steady-state ranges from hours to as long as days, depending on the characteristics of the reservoir. The loss of production during the shut-in period discourages frequent pressure transient well tests, and thus raises the cost of acquiring the data necessary for determining reservoir pressure, permeability, skin factor, and other well and reservoir characterization parameters.

Recent years have brought the development of reliable downhole pressure sensors that can be plumbed into the production string and left in the wellbore during production. The improved reliability of these sensors over time at elevated wellbore temperatures and pressures, has resulted in the increasing popularity of real-time downhole pressure sensors to continuously monitor downhole pressure during production at one or more wellbore depths in each well of a production field. These downhole sensors are typically used for monitoring and managing the individual wells, on a day-to-day basis.

The widespread deployment of these continuous-time downhole sensors in a production field rapidly generates a huge volume of data, especially considering that typical measurement frequencies are on the order of one measurement per second per sensor. While each shut-in of a producing well, planned or unplanned, provides an opportunity to perform pressure transient analysis, the volume of data and the tedious manual process required of the reservoir engineer to extract meaningful information such as reservoir pressure is often prohibitive. This tedious work process involves using unlinked computer applications to visually inspect the massive amount of downhole pressure measurement data, identify the build-up and its associated pressure and rate data, extract, filter, and format that data, and then perform the analysis itself. It is a massive task for the reservoir engineer simply to determine which data are important in analyzing the reservoir. In addition, meaningful analysis requires the reservoir engineer to locate, extract, filter, and correlate the data from wells over the entire production field, in order to draw accurate conclusions. It has been observed, in connection with this invention, that the time and effort required to perform this data analysis using conventional techniques reduces the frequency and timeliness of such analysis. In addition, the identification of the build-up and draw-down events is a somewhat subjective determination on the part of the petroleum engineer, reservoir engineer, geologist, operator, technician, or any other human user, rendering the analysis prone to inconsistencies and errors. These factors all limit the frequency and accuracy of reservoir pressure analysis performed in this conventional manner, and can lead to erroneous well and reservoir decisions caused by inaccurate and out-of-date information.

By way of further background, the automated gathering and filtering of downhole and surface pressure and flow measurements, in order to reduce the engineering effort required to analyze measurements by permanent downhole gauges during production, is known. According to one known report on such an automation effort, a zero flow rate over a measurement time period is detected as a shut-in period, and is analyzed as a "build-up" or shut-in well test according to an automated non-linear regression analysis.

BRIEF SUMMARY OF THE INVENTION

It is therefore an object of this invention to provide an automated system and method of operation in which measurements from permanent downhole sensors are processed and analyzed in connection with well shut-in events, to provide real-time measurements of reservoir pressure.

It is a further object of this invention to provide such a system and method in which such automated processing and analysis is triggered by the detection of a change in the well operating mode.

It is a further object of this invention to provide such a system and method in which the resulting reservoir pressure result and other results are used to update a previously established well model.

It is a further object of this invention to provide such a system and method in which the resulting reservoir pressure result and other results can be used to update a previously established reservoir or production field model.

It is a further object of this invention to provide such a system and method in which the measurements from the permanent downhole sensors are themselves processed, and the processed measurements are used to detect a change in the well operating mode that triggers automated processing and analysis of reservoir pressure and other well and reservoir parameters.

It is a further object of this invention to provide such a system and method in which the reservoir pressure parameter determined by the system and method is applied to an automated process and system for determining flow rates of multiple phases (oil, gas, water) from the well and production field.

Other objects and advantages of this invention will be apparent to those of ordinary skill in the art having reference to the following specification together with its drawings.

The present invention may be implemented into a system and method for monitoring sensor measurements from wellbores in land-based and offshore oil and gas production fields. The system includes data acquisition systems that obtain real-time measurements from the wellbore sensors during production, and that forward those measurements to an analysis system. In response to detecting a change in the operating mode for a well indicative of an abrupt change in flow for the well, downhole pressure measurements are acquired and analyzed over a period of time surrounding the change in well mode, at least until a steady-state is attained. According to one embodiment of the invention, the steady-state is indicated by stability in a calculated time rate of change of downhole pressure following shut-in of the well. The automated system determines a reservoir pressure from the steady-state condition, and notifies a reservoir engineer or other responsible personnel of the event. Upon the verification of the result by a user, the measurements are stored in a data base; in one embodiment of the invention, these stored measurements are used to update a model of the well or, optionally, of the reservoir. According to aspects of the invention, the user can be a human, such as a petroleum engineer, reservoir engineer, geologist, operator, technician, or any other human user; it is also contemplated that the user can be one or more computer and/or software or other equipment capable of receiving, analyzing, and arriving at a decision or plan of action, which can then be transmitted or otherwise input into the system.

DETAILED DESCRIPTION OF THE INVENTION

The present invention will be described in connection with its preferred embodiment, namely as implemented into an existing production field from which oil and gas are being extracted from one or more reservoirs in the earth, because it is contemplated that this invention will be especially beneficial when used in such an environment. However, it is contemplated that this invention may also provide important benefits when applied to other tasks and applications. Accordingly, it is to be understood that the following description is provided by way of example only, and is not intended to limit the true scope of this invention as claimed.

Figure 1:
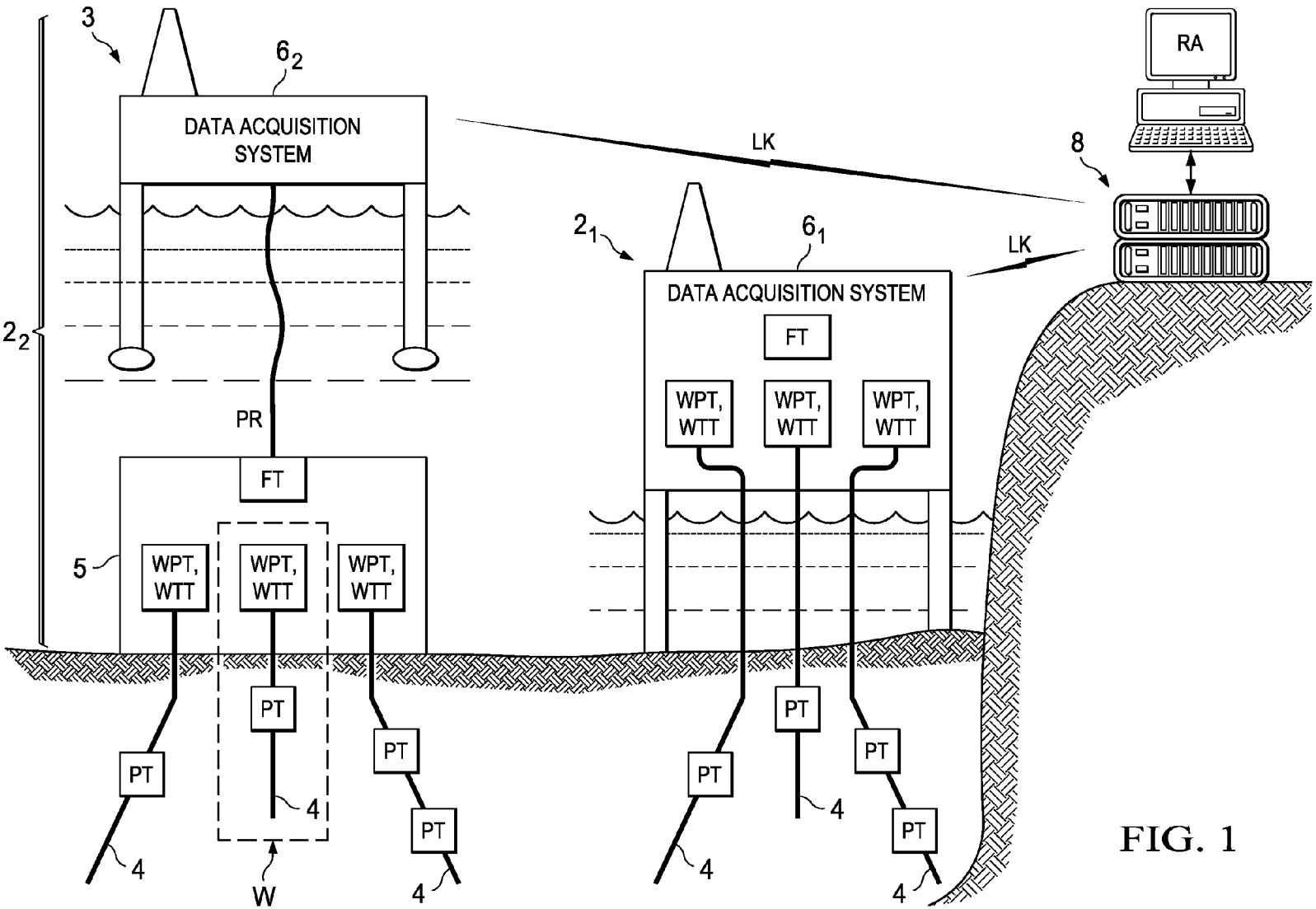
FIG. 1 is a schematic diagram illustrating the measurement and analysis system of an embodiment of the invention as deployed in a oil and gas production field.

FIG. 1 illustrates an example of the implementation of an embodiment of the invention, as realized in an offshore oil and gas production field. In this example, two offshore drilling and production facilities $\mathbf{2}_1$, $\mathbf{2}_2$ are shown as deployed; of course, more than two such facilities 2 may be used in a modern offshore production field. Each of facilities $\mathbf{2}_1$, $\mathbf{2}_2$ support one or more wells W, shown by multiple completion strings 4 associated with each facility 2. In this example, offshore facility $\mathbf{2}_1$ is shown as an offshore drilling and production platform, from which each of multiple completion strings 4 are supported. Facility $\mathbf{2}_2$. in the example of FIG. 1, is shown as the combination of floating (or semi-submersible) production, storage, and offloading vessel 3 at the ocean surface, and well center 5 deployed at the seafloor. Production strings 4 connect into a manifold (not shown) in well center 5 at the seafloor, at which flow from each production string 4 is combined and communicated to vessel 3 via production riser PR. A given completion string 4 and its associated equipment, including pressure transducers PT and the like, will be referred to in this description as a well W.

According to this preferred embodiment of the invention, one or more pressure transducers or sensors PT is deployed within each completion string 4. Pressure transducers PT are contemplated to be of conventional design and construction, and suitable for downhole installation and use during production. Examples of modern downhole pressure transducers PT suitable for use in connection with this invention include those available from Quartzdyne, Inc., among others available in the industry or known to those skilled in the art.

In addition, as shown in FIG. 1, conventional wellhead pressure transducers WPT are also deployed at the wellheads of each production string 4 to sense wellhead pressure. FIG. 1 also illustrates conventional wellhead temperature transducers WTT, which sense the temperature of the fluid output from a given well W; again, wellhead temperature transducers may also serve multiple wells W at a platform 2, if so deployed.

It is contemplated that other downhole and wellhead sensors may be deployed for individual wells, or at platforms or other locations in the production field, for example downstream from the wellheads, as desired for use in connection with this preferred embodiment of the invention. For example, downhole temperature sensors may also be implemented if desired. In addition, not all wells W may have all of the sensor and telemetry of other wells W in a production field, or even at the same platform 2; for example, injecting wells W will typically not utilize downhole pressure transducers PT, as known in the art.

Figure 2:
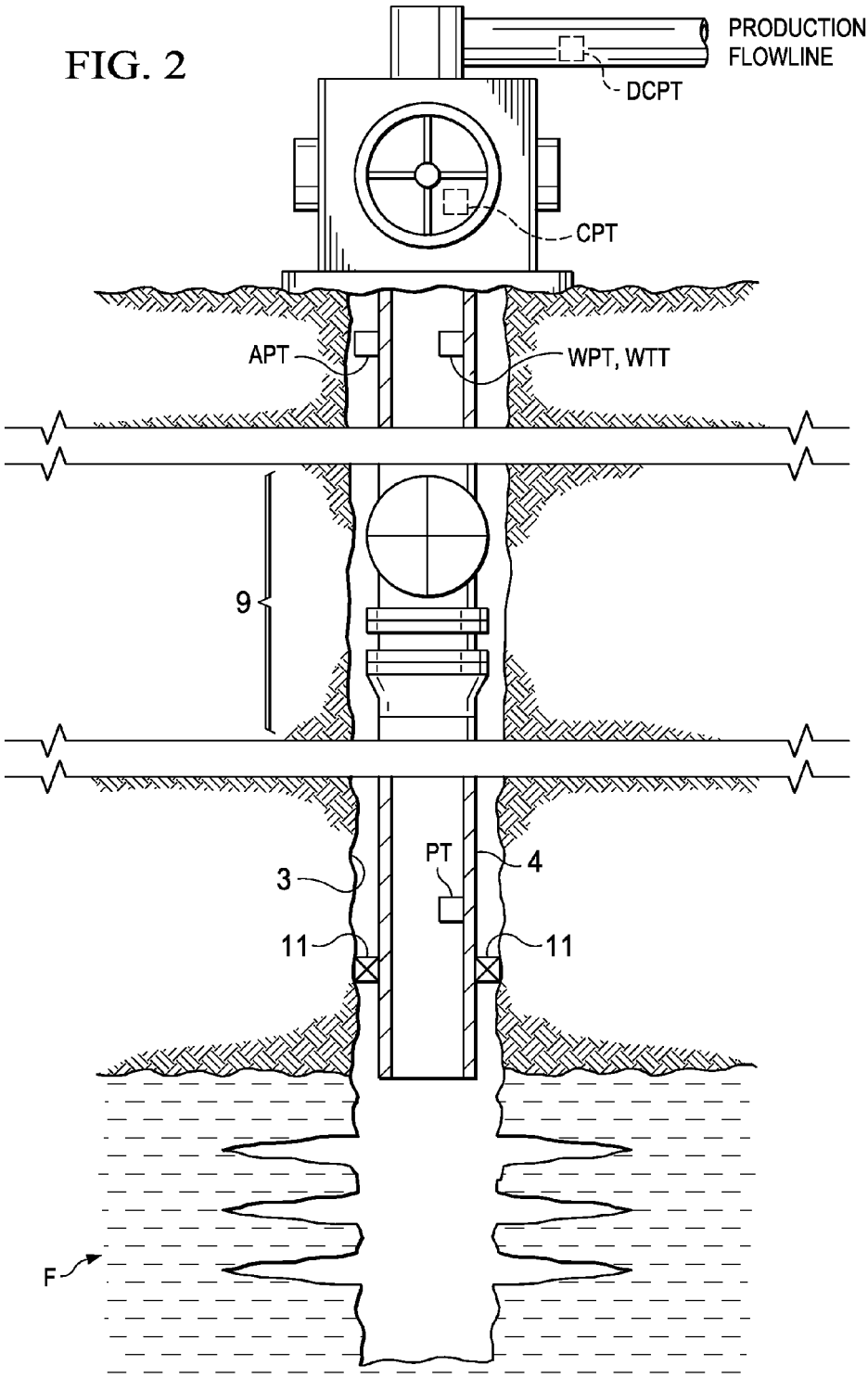
FIG. 2 is a schematic diagram illustrating an example of a location of a downhole pressure measurement device as implemented in the system of an embodiment of the invention.

FIG. 2 schematically illustrates an example of the deployment of various pressure, temperature, and position transducers along one of completion strings 4 in a given well $W_j$ in the production field illustrated in FIG. 1. FIG. 2 illustrates a portion of completion string 4 as disposed in a wellbore that passes into a hydrocarbon-bearing formation F. In this simplified schematic illustration, completion string 4 includes one or more concentric strings of production tubing disposed within wellbore 3, defining an annular space between the outside surface of the outermost production tubing and the wall of wellbore 3. Entries through the production tubing pass fluids from one or more formations F into the interior of the production tubing, and within any annulus between concentrically placed production tubing strings, in the conventional manner. The annular space between wellbore 3 and completion string 4 (and also any annuli between inner and outer production tubing strings) may be cemented to some depth, as desired for the well. Packers 11 may also be inserted into the annular space between wellbore 3 and completion string 4 to control the pressure and flow of the production stream, as known in the art. Completion string 4 terminates at the surface, at wellhead 9.

According to an embodiment of the invention, and as known in the art, downhole pressure transducer PT is preferably disposed in completion string 4 at a depth that is above the influx from the shallowest hydrocarbon-bearing formation F. As will become apparent from the following description, the shut-in condition of the well is of particular usefulness in the analysis method of an embodiment of this invention. As defined herein, the term shut-in means and refers to the closing off of the wellbore of an oil or gas well so that it does not produce a liquid or gas product of any kind. Downhole pressure transducer PT is in communication with data acquisition system 6 (FIG. 1) by way of a wireline or other communications facility (not shown in FIG. 2) in completion string 4.

As mentioned above, additional sensors may also be deployed in connection with completion string 4, for purposes of an embodiment of the invention, for example as shown in FIG. 2. Wellhead pressure and temperature transducers WPT, WTT, respectively, are deployed within wellhead 9 or at its outlets (as shown schematically in FIG. 2). In addition, well annulus pressure transducer APT may also be deployed at or near wellhead 9, for sensing the annular pressure between wellbore 3 and the outermost production tubing of completion string 4 near the surface. Other sensors and transducers specific to well W can also be deployed at wellhead 9. As shown in FIG. 2, these additional sensors include choke valve position indicator CPT at production choke valve 7 disposed downstream from wellhead 9 in the production flowline; choke valve position indicator CPT indicates the valve position of choke 7 and thus the extent to which the fluid path in the production flowline for well W is open. Pressure sensors and other sensors (not shown) may also be deployed downstream from wellhead 9, for example downstream of a production choke valve 7 as shown by pressure sensor DCPT, or at a downstream manifold at which the output of multiple wells W are combined. Each of these transducers illustrated in FIG. 2 for well W, and any other transducers utilized either downhole, at wellhead 9, or downstream from wellhead 9 in the production flowline, are coupled to data acquisition system 6 for the facility 2 or other arrangement of wells, so that the measurements can be acquired and forwarded to servers 8 according to an embodiment of the invention, as will be described below and as illustrated in FIG. 1.

As illustrated in FIG. 1, flow transducers FT are also optionally deployed at platform $\mathbf{2}_1$ and well center 5, in this example. Flow transducers FT are of conventional design and construction, for measuring the flow of fluid for a given phase (oil, gas, water), and are typically shared among multiple wells W in a field. Alternatively or in addition, as described in U.S. patent application Ser. No. 12/035,209, filed Feb. 21, 2008, commonly assigned with this application and incorporated herein by this reference, the flow from a given well or completion string can be determined from pressure transducers PT in combination with measurements of downhole temperature. In any case, and as will be described in further detail below, flow events at wells in the production field are used in the well and reservoir analysis according to this preferred embodiment of the invention.

Referring back to FIG. 1 for this example of an embodiment of the invention, facilities $\mathbf{2}_1$, $\mathbf{2}_2$ are each equipped with a corresponding data acquisition system $\mathbf{6}_1$, $\mathbf{6}_2$. Data acquisition systems 6 are conventional computing and processing systems for deployment at the production location, and that manage the acquisition of measurements from downhole pressure transducers PT, as well as from other measurement equipment and sensors for the wells W supported by the respective facility 2, such as flow transducers FT. Data acquisition systems 6 also manage the communication of those measurements to shore-bound servers 8, in this embodiment of the invention, such communications being carried out over a conventional wireless or wired communications link LK. In addition, data acquisition systems 6 each are capable of receiving control signals from servers 8, for management of the acquisition of additional measurements, calibration of its sensors, and the like. Data acquisitions systems 6 may apply rudimentary signal processing to the measured signals, such processing including data formatting, time stamps, and perhaps basic filtering of the measurements, although it is preferred that the bulk of the filtering and outlier detection and determination is to be carried out at servers 8.

Servers 8, in this example, refer to multiple servers located centrally or in a distributed fashion. Servers 8 operate as a shore-bound computing system that receives communications from multiple facilities 2 in the production field, and operate to carry out the analysis of the downhole pressure measurements according to this embodiment of the invention, as will be described in further detail below. Servers 8 can be implemented according to conventional server or computing architectures, as suitable for the particular implementation. In this regard, servers 8 can be deployed according to conventional server or computing architectures, as suitable for the particular implementation. For example, servers 8 can be deployed at a large data center, or alternatively as part of a distributed architecture closer to the production field and integrated across a wide-area computer network. For purposes of this description, "servers 8" refers to a computer system carrying out the functions of this preferred embodiment of the invention, whether implemented as a single server, or in an distributed multiple server architecture described herein. Also according to this embodiment of the invention, one or more remote access terminals RA are in communication with servers 8 via a conventional local area or wide area network, providing production engineers with access to the measurements acquired by pressure transducers PT and communicated to and stored at servers 8. In addition, as will become apparent from the following description, it is contemplated that servers 8 will be capable of notifying production engineers of certain events detected at one or more of pressure transducers PT, and of the acquisition of measurement data surrounding such events. This communication, according to this invention, provides the important benefit that the production engineers are not deluged with massive amounts of data, but rather can concentrate on the measurements at completion strings 4 for individual wells that are gathered at important events, from the standpoint of well and production field characterization and analysis.

While the implementation of an embodiment of the invention illustrated in FIG. 1 is described relative to an offshore production field environment, those skilled in the art having reference to this specification will readily recognize that this invention is also applicable to the management of terrestrial hydrocarbon production fields, and of individual wells and groups of wells in such land-based production. Of course, in such land-based oil and gas production, the wells and their completion strings are not platform-based. As such, each well or completion string may have its own data acquisition system 6 for communication of its transducer measurements to servers 8; alternatively, a data acquisition system may be deployed near multiple wells in the field, and as such can manage the communication of measurements from those multiple wells in similar fashion as the platform-based data acquisition systems 6 of FIG. 1.

Figure 3:
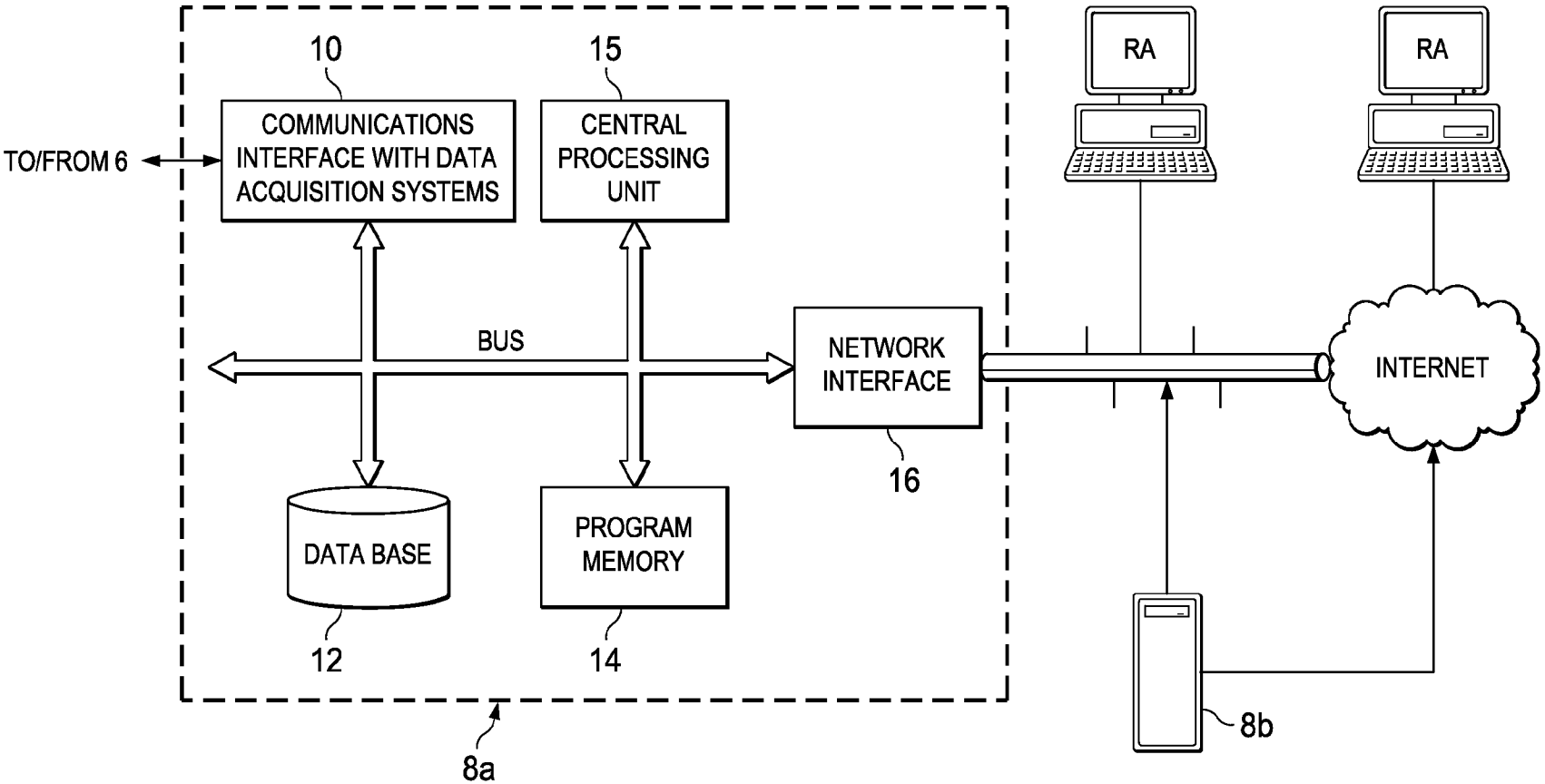
FIG. 3 is an electrical diagram, in block and schematic form, of a server-based computer system implementing the analysis system of an embodiment of the invention.

FIG. 3 illustrates an example of the construction and architecture of server 8*a*, according to an embodiment of the invention. The arrangement of server 8*a* shown in FIG. 3 is presented by way of example only, it being understood that the particular architecture of server 8*a* can vary widely from that shown in FIG. 3, depending on the available technology and on the particular needs of a given installation. Indeed, any conventional server architecture of suitable computational and storage capacity for the volume and frequency of the measurements involved in the operation of this preferred embodiment of the invention can be used to implement server 8*a*. As such, the construction of server 8*a* shown in FIG. 3 is presented at a relatively high level, and is intended merely to illustrate its basic functional components according to one arrangement.

In this example, communications interface 10 of server 8*a* is in communications with data acquisition systems 6 at platforms 2. Communications interface 10 is constructed according to the particular technology used for such communication, for example including RF transceiver circuitry for wireless communication, and the appropriate packet handling and modulation/demodulation circuitry for both wired and wireless communications. Communications interface 10 is coupled to bus BUS in server 8*a*, in the conventional manner, such that the measurement data received from data acquisition systems 6 can be stored in data base 12 (realized by way of conventional disk drive or other mass storage resources, and also by conventional random access memory and other volatile memory for storing intermediate results and the like) under the control of central processing unit 15, or by way of direct memory access. Central processing unit 15 in FIG. 3 refers to the data processing capability of server 8*a*, and as such may be implemented by one or more CPU cores, co-processing circuitry, and the like within server 8*a*, executing software routines stored in program memory 14 or accessible over network interface 16 (i.e., if executing a web-based or other remote application). Program memory 14 may also be realized by mass storage or random access memory resources, in the conventional manner, and may in fact be combined with data base 12 within the same physical resource and memory address space, depending on the architecture of server 8*a*. Server 8*a* is accessible to remote access terminals RA via network interface 16, with remote access terminals RA residing on a local area network, or a wide area network such as the Internet, or both (as shown in FIG. 3). In addition, according to this preferred embodiment of the invention, server 8*a* communicates with another server 8*b* via network interface 16, either by way of a local area network or via a wide area network, such as the Internet. Server 8*b* may be similarly constructed as server 8*a* described above, or may be constructed according to some other conventional server architecture as known in the art; in any event, it is contemplated that server 8*b* will include a central processing unit or other programmable logic or processor, and program memory or some other capability for storing or acquiring program instructions according to which its operation is controlled. Servers 8*a*, 8*b* may be arranged to operate different software components from one another, thus providing a distributed hardware and software architecture. As mentioned above and as will be apparent to those skilled in the art having reference to this specification, servers 8*a*, 8*b* may be realized by many variations and alternative architectures, including both centrally-located and distributed architectures, to that shown in FIG. 3 and described above. For example, the various functions of servers 8*a*, 8*b* described in this specification may be carried out on multiple servers or computers, deployed at the same or different physical locations relative to one another, such multiple servers or computers interconnected by way of a local area network (LAN) or wide-area network (WAN).

Figure 4:
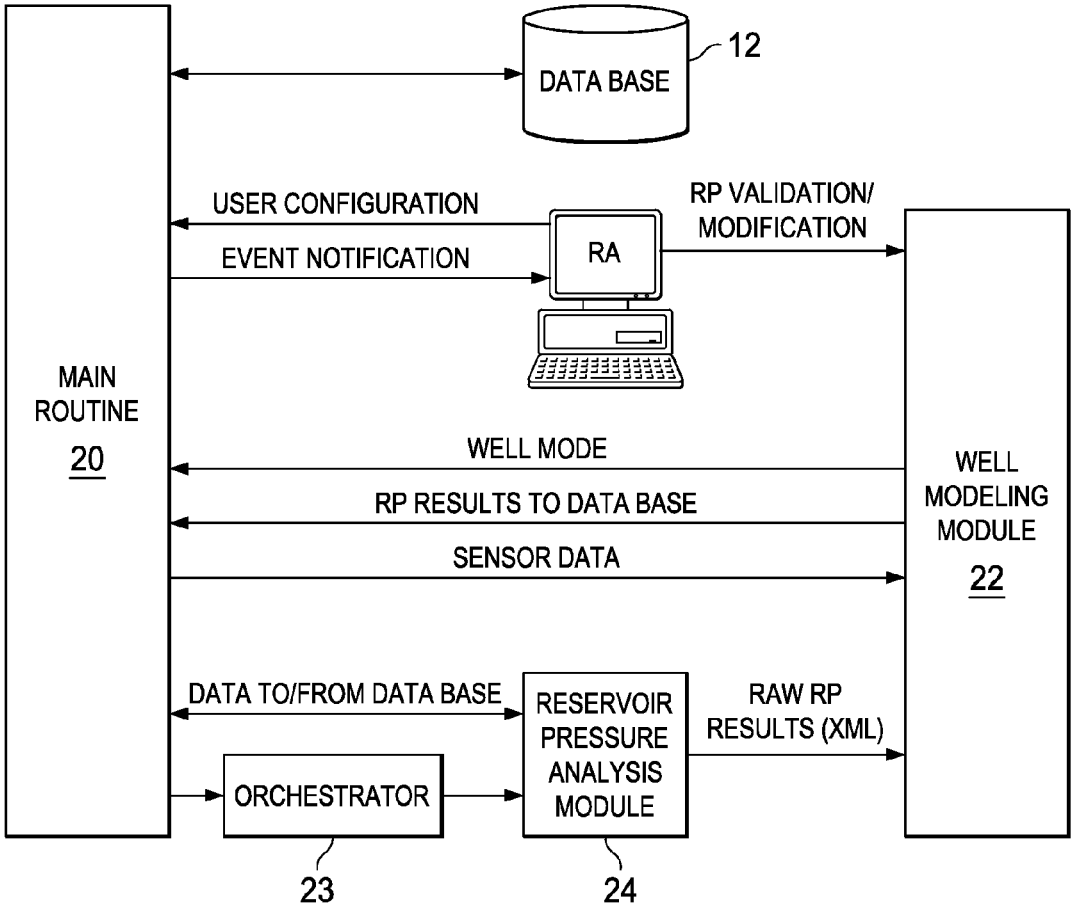
FIG. 4 is a block diagram illustrating the software architecture implemented in the server of FIG. 3, implementing the analysis system of that embodiment of the invention.

FIG. 4 illustrates an example of a software architecture implemented at servers 8*a*, 8*b*, according to this embodiment of the invention. According to this embodiment of the invention, various software modules 20, 22, 23 24 are resident in servers 8, for example stored within program memory 14, or resident elsewhere on the local area network or wide area network and communicated thereto by way of encoded information on an electromagnetic carrier signal. Each of software modules 20, 22, 23, 24 correspond to computer software routines or programs that are executable by servers 8, more specifically by central processing unit 15, for performing one or more of the functions described below. Of course, it is contemplated that other software modules and programs will also be executed by servers 8 or available for execution, for performing other analysis and control functions, as desired. In addition, it is contemplated that the particular software architecture illustrated in FIG. 4 and described herein is presented by way of example only, as many and varied alternative approaches and software architectures will also be suitable for carrying out the automated analysis of this preferred embodiment of the invention. Such alternative approaches and variations to the architecture of FIG. 4 will be apparent to the skilled reader who has reference to this specification. For example, one module in this architecture may reside on and be executed by one physical computer, while another such module may reside on and be executed by a separate physical computer at the same location or at a different physical location, with the multiple computers interconnected by and cooperatively operating over a LAN or WAN.

In this example, main routine 20 of FIG. 4 refers to a main computer program or module that, when executed, performs the management and control functionality for carrying out the automated analysis according to an embodiment of the invention. As evident from FIG. 4, main routine 20 manages the retrieval of data from and storage of data in data base 12, as well as the communication of data among data base 12 and the other software modules of the architecture. In addition, it is contemplated that main routine 20 responds to user or system operator control inputs to manage and carry out its functions. In this regard, it is contemplated that main routine 20 will be perpetually and continuously running on servers 8, serving to funnel data into and out of data base 12 during and in response to the continuous acquisition of pressure and temperature measurement data from wells W. In addition, this continuous operation of main routine 20 permits the generation and transmission of alerts to users (via their respective remote analysis terminals RA), as events are detected from these measurement data in the manner described below. In an embodiment of this invention, the users are humans. However, it is contemplated that the users can also be computers or other equipment capable of receiving, analyzing, and arriving at a decision or plan or action, which can then be transmitted to or otherwise input into the system. Main routine 20, in addition to transmitting alerts to remote analysis terminals RA, is also able to receive inputs from such remote analysis terminals RA, for example to receive inputs from a human user by way of which the operation of main routine 20 and the reservoir pressure analysis performed according to this embodiment of the invention is carried out.

The software architecture of servers 8 according to this preferred embodiment of the invention also includes well modeling module 22. Well modeling module 22 is a software module that is "called" or otherwise instantiated, by main routine 20, to receive sensor data stored in data base 12 and retrieved by main routine 20. This sensor data, according to this embodiment of the invention, includes data corresponding to measurements made by pressure transducer PT in a selected completion string 4, as well as other measurements such as wellhead pressure and temperature, choke position, and the like that are germane to the reservoir pressure and other analysis carried out by servers 8. Well modeling module 22 includes the appropriate computer program instructions and routines to process this retrieved sensor data from data base 12 in the manner described in further detail below. Based on that processing, well modeling module 22 provides an indicator of the current operating mode for the specific well corresponding to the communicated and processed downhole pressure measurements, as will be described in further detail below. As used herein, the term operating mode means and refers to the operational mode of the well. In an aspect of this invention, examples of the operating modes discussed herein are comprised of the producing mode and the shut-in mode (no flow). Within the producing mode, there can be several subcategories such as a steady phase/mode, an unstable phase/mode, an unknown phase/mode (open well, but no data which is available for computation), and an open but not flowing well phase/mode, for example. Within the unstable phase/mode, there may also be the start up transient phase/mode, the shut-in transient phase/mode, and a phase known as slugging. While these operating modes are provided by way of example, it is of course contemplated that other operating modes may be comprehended, as desired. As will be apparent from the following description, well modeling module 22 utilizes reservoir pressure analysis results in combination with its well modeling function, as may be verified and modified by the user; the resulting results are communicated by well modeling module 22 to main routine 20, for storage in data base 12 as appropriate, as will be described in further detail below. Commonly assigned and copending U.S. patent application Ser. No. 12/035,209, incorporated herein by this reference, describes an example of the construction, functionality, and operation of well modeling subsystem 22.

Main routine 20 is also operable to "call" or instantiate reservoir pressure analysis module 24, and to forward data from data base 12 to this reservoir pressure analysis module 24. According to an embodiment of the invention, as will be described below, the data forwarded to reservoir pressure analysis module 24 corresponds to downhole pressure measurements stored in data base 12, from which reservoir pressure analysis module 24 derives reservoir pressure analysis results for correlation with well modeling by well modeling module 22, and communication to a user as appropriate.

The software architecture of servers 8 according to an embodiment of the invention also includes orchestrator module 23, which cooperates with main routine 20 to manage its calling and instantiation of well modeling module 22 and reservoir pressure analysis module 24, and also the accesses of data base 12, among the multiple wells in the production field. In effect, orchestrator module 23 is a scheduler of the multiple analyses that are active within servers 8 for a given production field or fields. Such scheduling computer programs and algorithms, for the management and scheduling of multiple instances of processes, are conventional in the art, such that it is contemplated that those skilled in the art having reference to this specification will be readily able to realize orchestrator module 23 in connection with this preferred embodiment of the invention, using conventional techniques and without undue experimentation.

The operation of the system of FIG. 1, and in particular the operation of servers 8 as described above relative to FIGS. 3 and 4, according to an embodiment of the invention, will now be described in detail relative to the flow diagram of FIG. 5. This operation is provided by way of example only, considering the possible variations in hardware and software architecture of servers 8 mentioned above. However, this embodiment of the invention is contemplated to be especially beneficial in the automated analysis of the massive quantity of well data that is obtained from modern production fields, as will now be described.

In process 30, the downhole pressure measurements sensed by downhole pressure transducers PT, and also wellhead temperature and pressure measurements sensed by wellhead temperature transducers WTT and wellhead pressure transducers WPT, respectively, are acquired by data acquisition systems 6, and forwarded to servers 8 (e.g., server 8*a*). According to this preferred embodiment of the invention, the measurement data collected in data collection process 30 can also include measurements of pressure and temperature upstream and downstream of the wellhead control valve or valves, the positions of one or more wellhead and production control valves, properties of fluid samples, measurements from flow transducers FT, and the like. In process 32, servers 8 store data corresponding to these measurements in data base 12, under the operation of main routine 20 (FIG. 4). Of course, not all of these measurements will be available from every well W, or at all times. In addition, it is contemplated that the frequency with which these measurements are acquired will vary from measurement to measurement.

In this regard, these measurements may be acquired and forwarded in a real-time manner (i.e., at or near the frequency at which the measurements are obtained from downhole, for example at a frequency of on the order of once per second), or gathered at data acquisition systems 6 and forwarded as a batch to servers 8, depending on the implementation and available communications technology. It is contemplated that this forwarding of acquired data by data acquisition systems 6, to servers 8, will be relatively frequent, but not necessarily on a measurement-by-measurement basis. For example, current-day downhole and wellhead transducers acquire measurements as frequently as once per second. It is contemplated that data acquisition systems 6 will obtain and process those measurements for a given well over some time interval and thus periodically forward those processed measurements for the interval to servers 8. For example, it is contemplated that the forwarding of acquired data to servers 8 may occur on the order of a few times a minute (e.g., every fifteen seconds). The particular frequency with which this forwarding occurs is preferably set by way of user input.

In process 34, main routine 20 invokes well modeling module 22 to process pressure measurements for a given well $W_j$ in the production field, as well as any measurements of temperature, flow, and surface or wellhead pressure. For a well $W_j$ that is a producing well, it is preferred that these pressure measurements are from downhole pressure transducers PT (as shown in FIG. 1), rather than from surface pressure sensors. However, for an injecting well $W_j$, it has been observed that either downhole or surface pressure measurements can be used for determining reservoir pressure, etc. It is contemplated, therefore, that the type of pressure measurements acquired can depend on the operating state of well $W_j$. While the following description will refer to downhole pressure measurements, as obtained for a producing well $W_j$, it is therefore to be understood that this preferred embodiment of the invention is similarly applicable to injecting wells, using surface pressure measurements.

Figure 6:
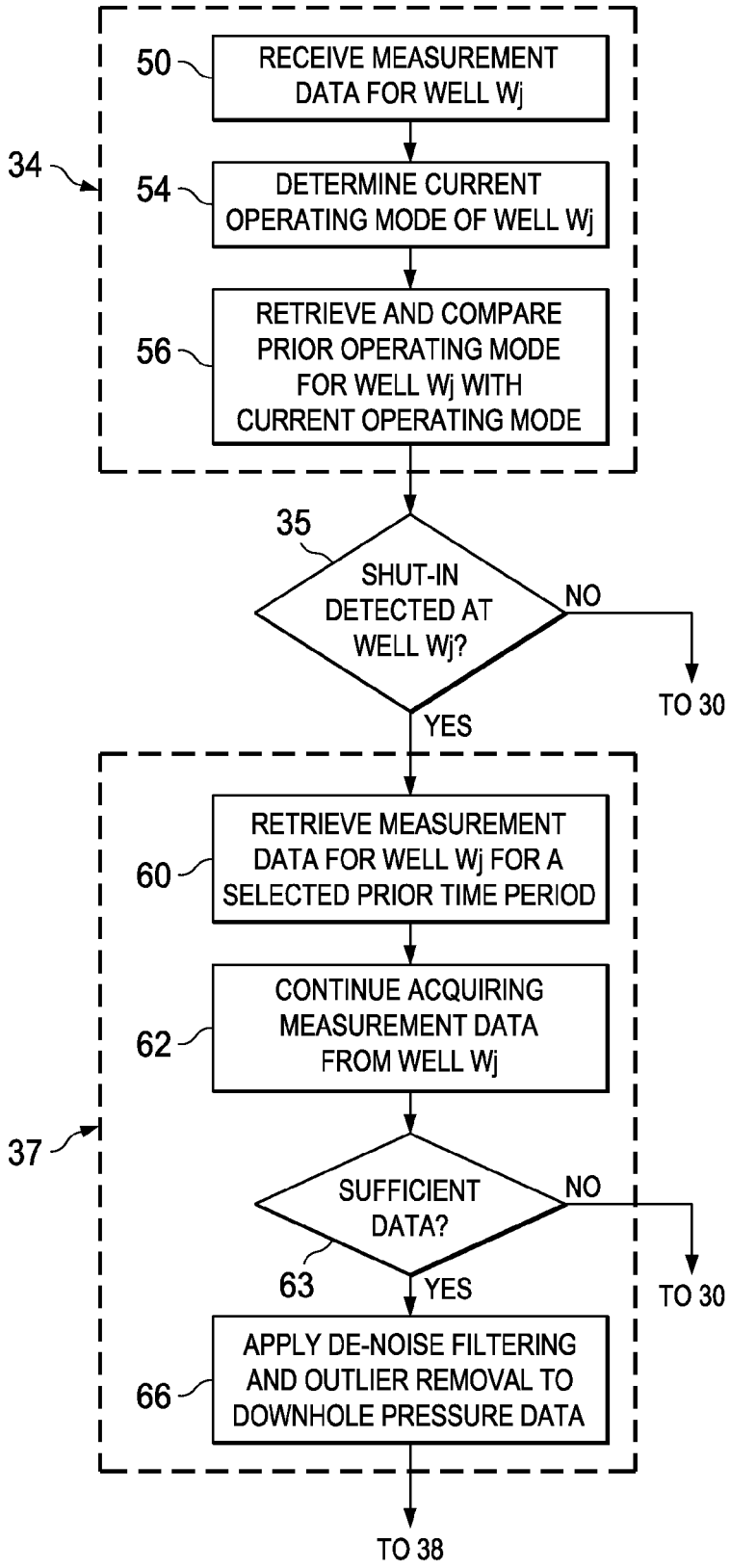
FIG. 6 is a flow diagram illustrating, in further detail, the operation of a well modeling module in processing downhole pressure data in the method of FIG. 5, according to that embodiment of the invention.

In process 34, well modeling module 22 applies these measurements to one or more then-existing well models to derive a current operating mode of well $W_j$, and thus to determine whether a change in this operating mode has occurred within the time period represented by the received data, in decision 35. FIG. 6 illustrates, in further detail, the operation of process 34 according to this embodiment of the invention. As mentioned above, it is contemplated that these operations are carried out by well modeling module 22 in a software architecture such as that described above relative to FIG. 4 and implemented in servers 8 of FIG. 3. In this example, process 34 begins with process 50, in which pressure measurement data is received by well modeling module 22 over a recent time period of interest for well $W_j$. This pressure measurement data is preferably downhole pressure measurement data, as obtained by downhole pressure transducers PT deployed for a producing well $W_j$. in the manner described above. As noted above, if well $W_j$ is an injection well, as used in conventional secondary recovery, either downhole pressure measurements or surface pressure measurements can be received in process 50. Other measurement data, such as downhole temperature data, can also be received in process 50, as required in order to determine a current operating state of well $W_j$ in process 54, as will now be described. In general, the measurements utilized in this determination of operating state include the positions of choke valve 7 and other valves at wellhead 9, and the variation over recent time of pressure and temperature measurements at well W.

Figure 7:
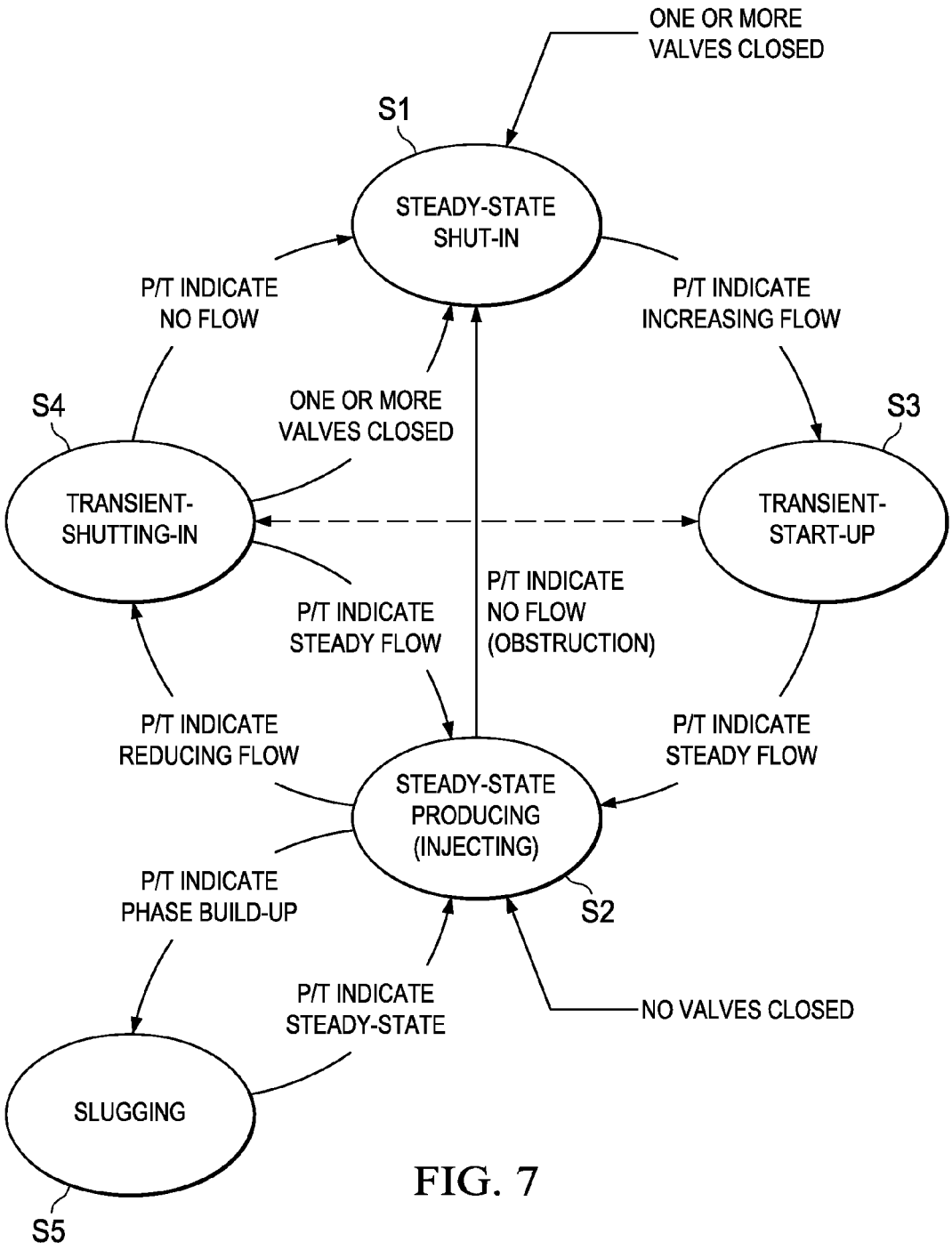
FIG. 7 is a state diagram illustrating the determination of a current well operating state, in the method of FIG. 6 and according to that embodiment of the invention.

The operation of process 54, according to this embodiment of the invention, will now be described in detail in connection with FIG. 7. In the example of FIG. 7, five potential operating states S1 through S5 for well $W_j$ are illustrated, along with conditions that can cause a transition from one state to another. Steady-state shut-in state S1 corresponds to a well $W_j$ through which no flow is passing, while steady-state producing (or injecting) state S2 corresponds to the state in which well $W_j$ is passing fluid in a relatively steady-state. The steady-state states S1, S2 can be initially detected, in this process 54, based on the position of choke valve 7 or other valves in the production flowline of well $W_j$; if any one of those valves is sensed to be in a closed position, steady-state shut-in state S1 is detected, because of the absence of flow necessarily resulting in that condition. Conversely, if choke valve 7 and all other valves in the flowline are open, in combination with detected changes in temperature or pressure consistent with an open and flowing choke 7, steady-state producing state S2 can be entered. As evident in FIG. 7, steady-state producing state S2 can also apply to well $W_j$ being used as an injecting well; the distinction between producing and injecting steady-state conditions is preferably made based on identifying information stored a priori for well $W_j$ in database 12.

Transient start-up state S3 corresponds to the state of well $W_j$ as it makes the operational transition from the steady-state shut-in state S1 to steady-state producing state S2. According to this preferred embodiment of the invention, transient start-up state S3 is detected in process 54 based on calculations made according to a predictive well model under the control of well modeling module 22, based on the applying of the pressure and temperature measurements at well $W_j$ to one or more predictive well models. The manner in which such well models derive rate and phase information will be described in further detail below. Also according to this preferred embodiment of the invention, changes in these temperature and pressure measurements over time can indicate the presence of fluid flow through well $W_j$. The detection of increasing flow, by way of changes in these pressure and temperature measurements over recent time, thus causes a transition in the operating state of well $W_j$ from steady-state shut-in state S1 to transient start-up state S3, and detected in process 54. Similarly, based on the pressure and temperature measurements as applied to one or more predictive well models for well $W_j$ indicating, over recent time, that a non-zero flow is present but is not substantially changing, a transition from transient start-up state S3 to steady-state producing state S2 occurs, and is detected in process 54.

Conversely, transition from steady-state producing state S2 to transient shutting-in state S4 can be detected, in process 54, by the pressure and temperature measurements for well $W_j$ indicating, over recent time and by way of one or more predictive well models, that the fluid flow through well $W_j$ is reducing. If these pressure and temperature measurements and well models indicate that there is no flow at all through well $W_j$ (despite all valves being open), a transition directly from steady-state producing state S2 to steady-state shut-in state S1 can be detected in process 54. This condition can exist if an obstruction becomes lodged somewhere in well $W_j$ or its production flowline. Finally, the transition from transient shutting-in state S4 to steady-state shut-in state S1 is detected, in process 54, by either the pressure and temperature measurements indicating no flow through well $W_j$, or by detection of the closing of at least one valve in the production flowline. Conversely, if the flow stabilizes, albeit at a lower level than previously, as indicated by pressure and temperature measurements monitored over time in process 54, a transition back to steady-state producing state S2 can be detected. Transitions directly between transient start-up state S3 and transient shutting-in state S4, and vice versa, may also be detected if a valve is being re-closed, re-opened, or otherwise adjusted during a transient event.

Finally, unstable or abnormal flow conditions can also be detected by operation of process 54, in which the operating state or mode of well $W_j$ is detected according to an embodiment of the invention. As known in the art, the term "slugging" refers to the condition of a well fluid production becomes unstable, in the sense that the fluid phases separate into slugs that are produced at different rates, causing turbulent flow in the wellbore. Such slugging is manifest as pressure and temperature pulses, with the measured wellhead pressure behaving antithetically with measured downhole pressure. Slugging can induce pressure surges in neighboring wells in the production field that are commingled with the slugging well. FIG. 7 illustrates slugging state S5, which can be detected according to this preferred embodiment of the invention from the antithetical behavior of downhole and wellhead pressure measurements; the transition from slugging state S5 back to steady-state producing state S2 is, of course, detected by a return to the proper relationship of wellhead and downhole pressures.

In this manner, the operating state of a given well $W_j$ is detected in an automated manner, from valve position signals and also measurements of pressure and temperature downhole or at the wellhead or both, at that well $W_j$. The operating state of well W is retained upon completion of process 54, following which control passes to decision 56.

Upon determining the current operating mode of well $W_j$ in process 54, well modeling module 22 executes process 56 to retrieve the previous operating mode of well $W_j$, preferably as most recently determined in one or more previous iterations of process 54. These operating modes, including both the current operating mode and at least one previous operating mode of well $W_j$, are the results of process 34.

Referring back to FIG. 5, upon completing process 34, well modeling module 22 then next executes decision 35 to determine whether a transition in the current operating mode of well $W_j$ indicative of an abrupt change in rate has been detected. Of course, a primary example of such an abrupt rate changes detected by decision 35 is a transition to shut-in state S1, which leads to pressure transient analysis. Other abrupt flow changes that can be used in a determination of reservoir pressure according to this embodiment of the invention, and thus which may be detected in decision 35, include a partial shutting-in of well $W_j$, the initiation of production flow (i.e., such as in a "drawdown" pressure transient analysis), and the like. If no such abrupt change in flow is detected (decision 35 is NO), well modeling module 22 returns control back to process 30 to await the receipt of new data for well $W_j$, or for another well if well modeling module 22 is operating in a sequential rather than parallel manner. On the other hand, if well modeling module 22 identifies a change in operating mode of well $W_j$ into a shut-in state or another type of abrupt change in flow (decision 35 is YES), control passes to process 37 by way of which well modeling module 22 acquires additional measurement data for well $W_j$ and processes that additional data along with the recently received measurement data, as will be useful in the determination of reservoir pressure in the manner described below.

FIG. 6 illustrates the operation of process 37 according to an embodiment of the invention in further detail. As shown in this Figure, following a YES result from decision 35, process 37 begins with process 60, by way of which well modeling module 22 retrieves measurement data for well $W_j$ for a time period beginning prior to the approximate time of the detected change in operating mode of well $W_j$. In aspects of this invention, the time period may be set in hours, days, or months, for example. In one embodiment, the time period is 1 to 8 hours; in another embodiment the time period is 8 to 16 hours; in a further embodiment, the time period is 12 to 48 hours, or a few days, for example. The data retrieved in process 60 includes time-stamped downhole pressure measurement data (for the example of a producing well $W_j$) or surface pressure measurement data (for a well $W_j$ that is either a producing well or an injection well), and such other data as desired or appropriate for the analysis described below. These data are obtained from data base 12 via main routine 20, according to the architecture of FIG. 4, and forwarded to well modeling module 22 for analysis.

Process 62 is then executed by well modeling module 22 to continue acquiring pressure measurement data from well $W_j$ for a time continuing after the detected change in operating mode. This process 62 may be executed with the assistance of main module 20 to retrieve these measurement data already stored in data base 12 during the intervening time from the change in operating mode at well $W_j$ itself and prior to the detection of that operating mode change by servers 8, and may also involve the acquisition of real-time data from well $W_j$ if this detection occurred rapidly enough. These new pressure measurement data are continued until a termination criterion is met, at which time either sufficient data has been acquired according to this embodiment of the invention, or there is an indication that applicable data has become no longer available.

As will become evident from the following description, accurate determination of reservoir pressure using pressure transient analysis is based on obtaining downhole pressure data from a time prior to a change in state (shutting-in or drawing-down) until a steady state condition is reached. In the case of the more usual build-up pressure analysis of a well that is shut-in, this steady-state condition can be detected by way of several indicators.

Figure 8:
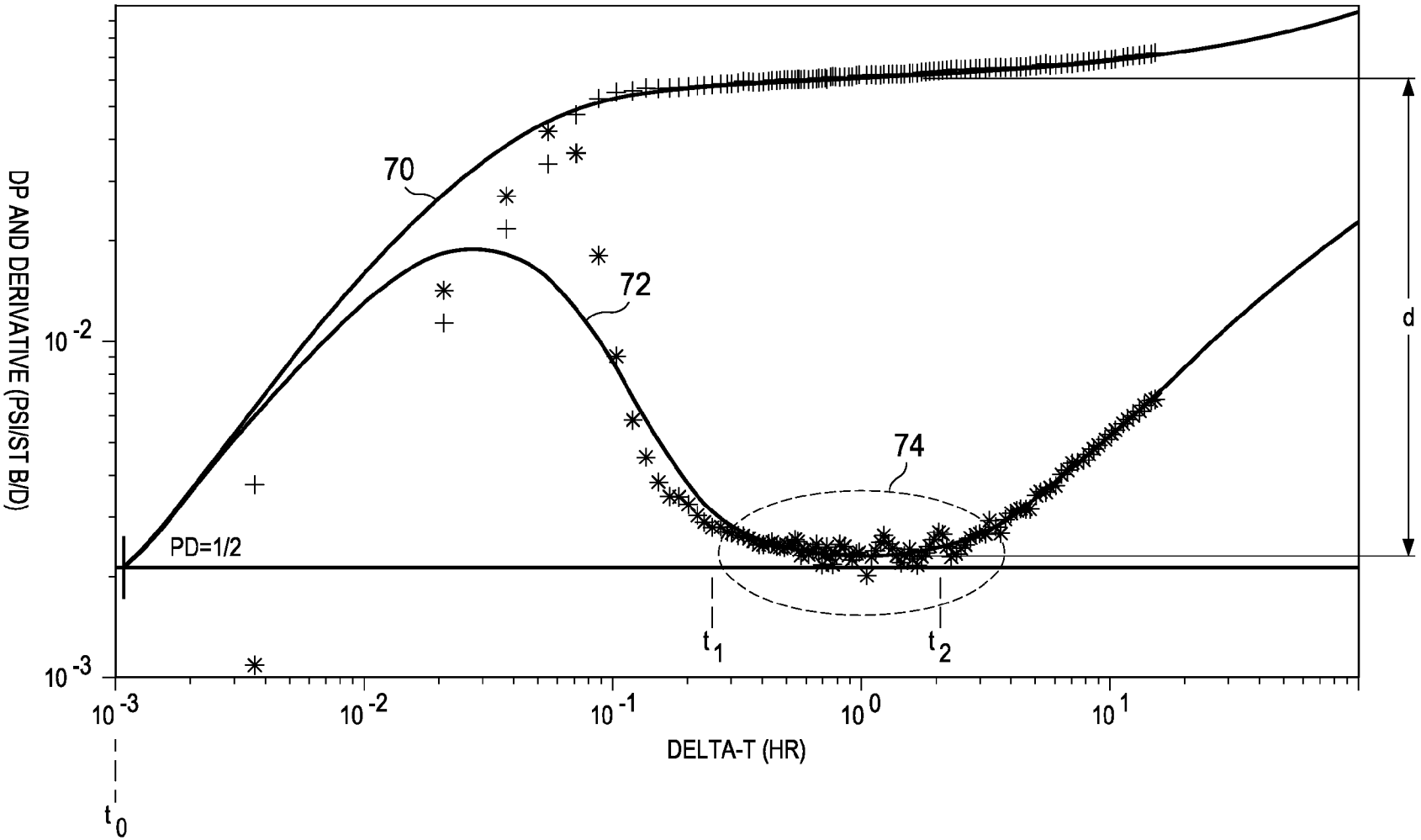
FIG. 8 is a plot illustrating an example of the determination of sufficient data from a steady-state condition, in the method of FIG. 5 and according to that embodiment of the invention.

According to a preferred embodiment of the invention, the post-event data is gathered in process 62 until a steady-state condition can be detected, for example upon the flattening of the time rate of change of downhole pressure (i.e., the derivative dP/dt becomes constant). FIG. 8 illustrates an example of this condition on a log-log scale, over a period of time following a shut-in event occurring at time $t_0$. Plot 70 in FIG. 8 represents a best-fit curve of measured downhole pressure over this time interval; the actual measurements are illustrated by the +symbols. As known in the art and as evident from FIG. 8, downhole pressure increases upon the closing of the choke at the top of a well completion string. Plot 72 is a best-fit curve of the time-rate of change of downhole pressure (i.e., the derivative dP/dt) over this period, with the calculated derivative values indicated by the * symbols in FIG. 8. The steady-state condition that is useful for the analysis of reservoir pressure, based on measurements of downhole pressure, is that condition in which the time-rate of change of downhole pressure is constant. This time period, which is on the order of one to four hours after shut-in, in this example, is illustrated by region 74 in FIG. 8. The use of downhole pressure measurements obtained during this steady-state period 74, to derive a measure of reservoir pressure, will be described in further detail later in this specification.

Typically, the termination criterion for process 62 is simply the elapse of a selected duration of time following the change in operating mode, based on an assumption of the time required to reach steady-state after that change, preferably based on the greatest distance between well $W_j$ and the boundary of the drainage area for the reservoir. In this approach, the gathered downhole pressure measurement data is analyzed at a first selected time (e.g., at about fifteen minutes after the mode change at time $t_0$, shown as time $t_1$ in FIG. 8); if the pressure does not indicate a steady-state condition at that first time, a second analysis of the gathered downhole pressure measurement data is carried out at a later time (e.g., at about two hours after time $t_0$, as shown as time $t_2$ in the example of FIG. 8) to determine whether the steady-state has been reached. It is contemplated that the time $t_2$ at which the later analysis is performed can be selected based on the analysis at time $t_1$. Of course, if steady-state operation is not detected at the later time $t_2$, the analysis can be repeated at yet another later time. Another example of a termination criterion is the detection of another change in well operating mode by well modeling module 22, based on the measurements obtained in process 62. For example, if a well changes from a producing to a shut-in state and then back to a producing state, by a rapid sequence of closing and then opening the choke, the change of operating mode back to producing would terminate the gathering of measurement data in process 62.

Once process 62 is terminated, decision 63 is executed by well modeling module 22 to determine whether sufficient data were acquired in the time following the detected change of operating mode. If not (decision 63 is NO), which can be the case if the well again changes operating mode only for a brief (e.g., <1 hour) period of time, the data acquired may be insufficient for reservoir pressure analysis. This insufficiency typically results from the lack of sufficient time for a steady-state condition to be reached. In this event, control returns to the normal measurement gathering of process 30 (FIG. 5).

Process 66 is then performed by well modeling module 22 to apply conventional de-noise filtering, and to remove outlier measurements from the data set corresponding to the period of time including the shut-in time $t_0$ and the data set of measurements during the steady-state operating period. As conventional in the art, outliers can be identified as those measurements that are outside of a statistical bound, for example beyond $\pm 3\delta$ in the expected distribution for the measurements. These de-noised filtered data are then stored in the appropriate memory resource, for example back in data base 12. Process 37 is then complete for the current well $W_j$, and control passes to main routine 20 for execution of process 38 (FIG. 5).

In process 38, main routine 20 invokes orchestrator module 23, which schedules the reservoir pressure analysis based on the gathered and filtered downhole pressure measurements from well $W_j$, among the similar analyses (if any) also being performed by servers 8. If only the analysis for well $W_j$ is ongoing, then orchestrator module 23 initiates analysis for that well $W_j$ in process 40. If multiple instances of reservoir pressure analysis are ongoing, orchestrator module 23 will schedule and coordinate such multiple analyses in an orderly manner, for example sequentially based on a priority or other arbitration among the currently operating processes. This scheduling may also take into account the position of well $W_j$ in the production field, and relative to other wells based on their current operating condition.

Reservoir pressure analysis module 24 then executes process 40 to perform its analysis based on the downhole pressure measurements currently stored in data base 12, following the processing of process 37 etc. by well modeling module 22. This analysis is intended to produce a "raw" reservoir pressure result, along with such other results as may be calculated based on these downhole pressures.

Various approaches to the determination of reservoir pressure from downhole pressure measurements are known in the art. According to an embodiment of the invention, reservoir pressure is determined in process 40 by determining an extrapolated pressure P* as a straight-line extrapolation of pressure to time t=0 on a superposition plot. The time axis of this type of plot has, encapsulated within it, a specialized mathematical function that enables the straight-line extrapolation used to calculate extrapolated pressure P*. Several different functions can be encapsulated into the time axis of the superposition plot, to example different types of flow function. These functions are well known and widely published in the art, illustrative examples of which include "Basic Surveillance" (Well Test Solutions, Inc.), available at http://www.welltestsolutions.com/BasicSurv.pps, and Home, *Modern Well Test Analysis: A Computer Aided Approach,* 2d ed. (Petroway, Inc.; 1995), both incorporated herein by this reference. According to this approach, the extrapolated reservoir pressure P* is an approximation that is strictly correct only for a homogeneous, infinite-acting, reservoir; this approximation is limited, in the practical sense, because the estimate P* is affected by reservoir heterogeneities, along with reservoir pressure.

Various techniques are also known in the art that, in theory, provide more accurate estimates of reservoir pressure than the P* estimate from the Wilson Spreadsheet. For example, the well-known "Dietz" average pressure method applies a correction to the Wilson Spreadsheet P* estimate for the effect of reservoir boundaries, based on a user-defined reservoir "shape factor". Other known approaches include determining an estimate of reservoir pressure $P_{roi}$ that is determined over a user-selected radius of investigation from the well location, and determining a "ratio average pressure" $P_{ratio}$ as an early-time ratio of radius of investigation pressure $P_{roi}$ to a reservoir pressure value that is derived from a full build-up analysis. These and other variations and methods for determining reservoir pressure from the acquired pressure measurements, according to the processing of this embodiment of the invention, may be used. However, as will become apparent from the following description, because this preferred embodiment of the invention utilizes review and correction by a user, the relatively simple extrapolation analysis is a preferred initial approach to reservoir pressure determination. Alternatively, variations in the extrapolated reservoir pressure value P* obtained from the "Wilson Spreadsheet" method will correspond to variations in actual reservoir pressure, even if the absolute value of the extrapolated reservoir pressure value P* does not accurately reflect the actual reservoir pressure.

Figure 9A:
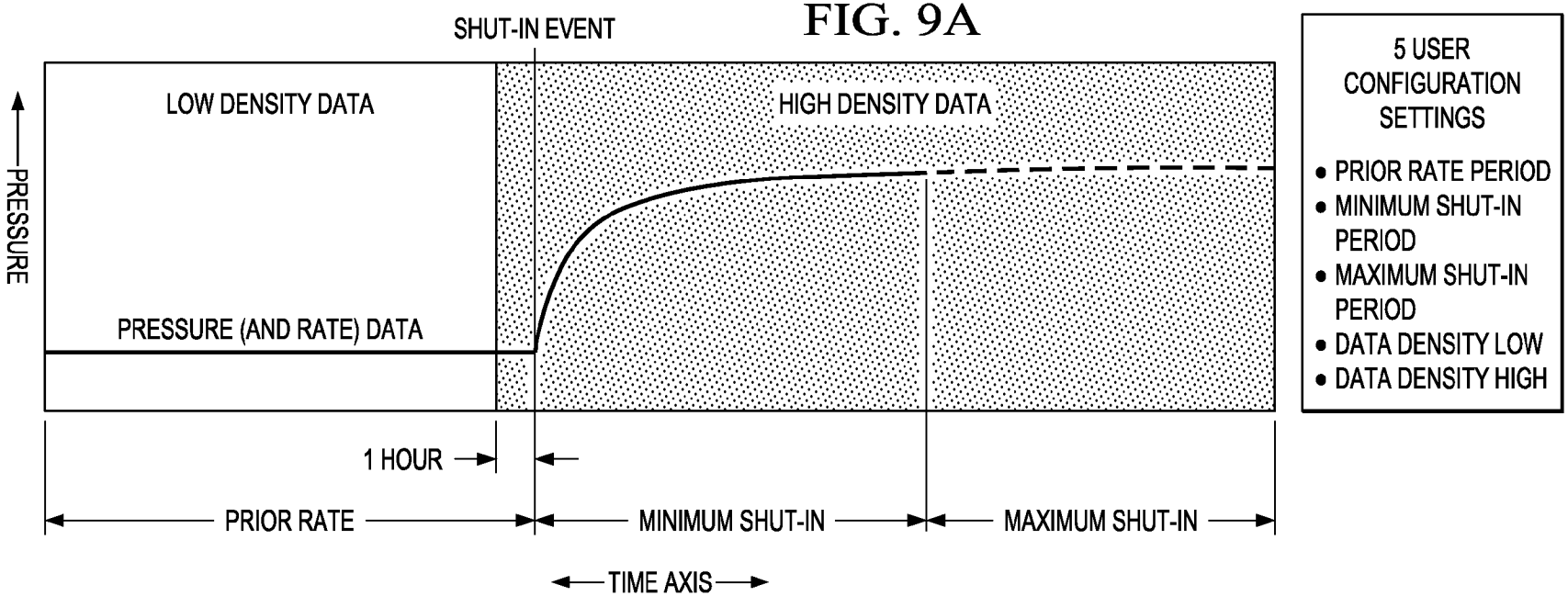
FIG. 9A is a diagram illustrating the preconfigured parameters used by the system to control the acquisition of data from the database of the respective well.
Figure 9B:
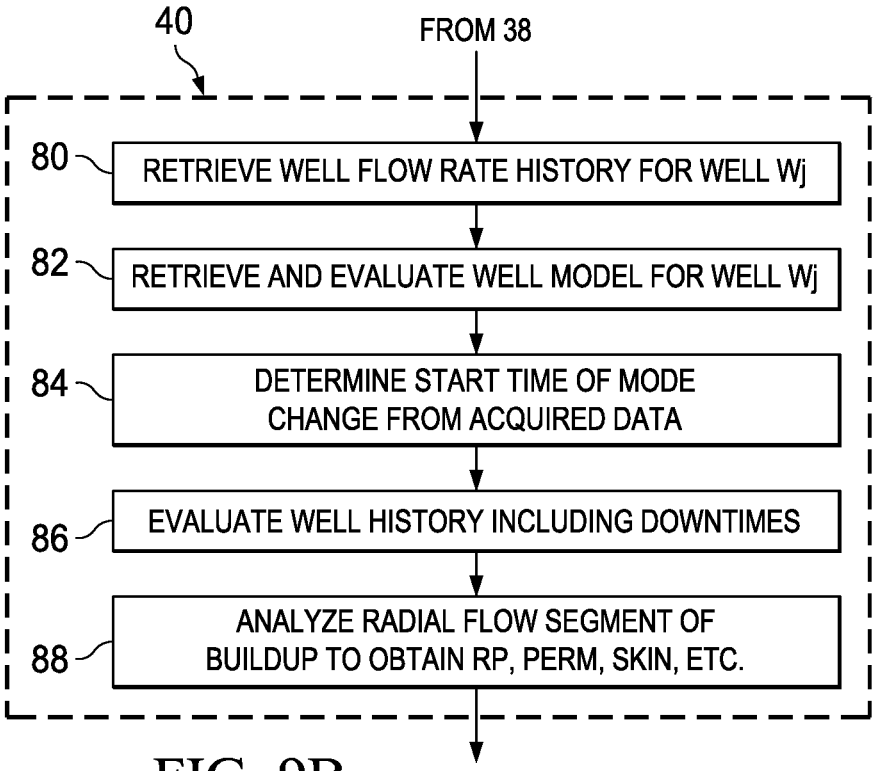
FIG. 9B is a flow diagram illustrating, in further detail, the operation of estimating reservoir pressure from downhole pressure data, according to an embodiment of the invention.

Referring now to FIGS. 9A and 9B, the manner in which reservoir pressure analysis module 24 performs process 40 according to an embodiment of the invention will now be described in detail. According to this preferred embodiment of the invention, reservoir pressure analysis process 40 begins with the retrieval of various control parameters to configure the dataset to be acquired and also retrieval of the stored data itself. Some of these control parameters and stored data are illustrated in FIG. 9A. One such control parameter shown in FIG. 9A is a certain shut-in period (Minimum Shut-In Duration) that is to elapse before it is appropriate to analyse the data for dynamic properties. Another configurable parameter is the maximum period of analysis, which is shown in FIG. 9A as "Maximum Shut-In Period". Another configurable parameter is the "Prior Rate" period (FIG. 9A) indicating the range of previous data corresponding to a well rate history for a given well $W_j$ to be gathered from data base 12 via main module 20, in process 80 (FIG. 9B), upon detection of the shut-in event. Another example of a configurable parameter is the density (frequency of data points) of the well rate history data received in process 80; as suggested by FIG. 9A, one approach for this configuration is to select between specified low and high data densities, so that higher density data can be gathered for the time period immediately prior to shut-in and during the shut-in event itself (e.g., amounting to on the order of an hour of high density data), relative to the lower density at which prior-rate data is gathered for times prior to shut-in.

According to embodiments of the invention, the well rate history data that are retrieved in process 80 can come from multiple and various sources. In this example, this well rate history corresponds to a time series of previous rate and phase information as calculated by the applicable model for well $W_j$ over a recent period of time. According to an embodiment of this invention, the rate and phase information includes flow rates, and in certain cases phase composition, of the fluids produced from well $W_j$, as calculated from downhole pressure, wellhead temperature, wellhead pressure, and other measured parameters that are applied to one or more predictive well models, in the manner described in the above-incorporated copending and commonly assigned U.S. patent application Ser. No. 12/035,209. Other sources of well rate history data can include stored rate history data acquired from conventional well tests, such as those performed during drawdown periods prior to the current shut-in, such data including date-and-time, fluid (oil, water) and/or gas rates, and perhaps wellhead temperature and pressure and separator temperature and pressure. In addition, according to an embodiment of the invention and as will be described in further detail below, the data acquired in process 80 also includes information indicating the dates and times at which well $W_j$ was shut-in (i.e., the "downtimes" of well $W_j$). These downtimes are useful in adjusting the rate history of the well, to improve overall accuracy of the reservoir pressure determination according to this embodiment of the invention.

This "history" of rate and phase information for well $W_j$ preferably includes rate and phase information acquired over a time period that is based on a parameter corresponding to the greatest distance between well $W_j$ and the boundary of the drainage area for the reservoir. According to an embodiment of the invention, the initial determination of reservoir pressure is based on the well-known assumption of radial flow into a vertical well from an infinite-acting homogeneous reservoir. Under this assumption, the transient response at a shut-in well reflects previous pressure transients resulting from previous rate changes at that well; in an infinite-acting reservoir, the transients from all such previous rate changes over the entire life of the well remain in the system. Of course, actual reservoirs are in fact not infinite-acting; as such, only those pressure transients due to rate changes that are still affecting the drainage area of the shut-in well need, and ought, to be considered. As such, as known in the art, a time period referred to as the time-to-pseudo-steady-state $T_{psss}$ is derived from a selected radius of investigation. The necessary rate history data acquired in process 80 thus relates to this time $T_{psss}$ as may be estimated according to conventional techniques for well $W_j$.

In process 82, well modeling module 22 performs various well modeling calculations for well $W_j$, to the extent that such well modeling calculations do not depend on the reservoir pressure, permeability, and skin factors that will be solved later in process 40. These calculations are based on sensor data for well $W_j$ as retrieved by main routine 20, as well as on various well configuration parameters, and using conventional well modeling software packages, such as the PROSPER modeling program available from Petroleum Experts Ltd., for example; examples of other conventional modeling software that may be used include the PIPESIM modeling program available from Schlumberger, the WELLFLOW modeling program available from Halliburton, and such other modeling programs available or known to those skilled in the art. The calculations of process 82 may be carried in parallel with other calculations in process 40, to the extent practicable. In summary, process 82 performs those calculations that are useful in the preparation of derivatives of pressures, and in the preparation of prior rate values for use as inputs to the superposition function, as will be described below.

In process 84, reservoir pressure analysis module 24 determines a precise start time for the mode change (e.g., shut-in time) using the well pressure measurement data obtained in processes 60, 62. As known in the art, a finite period of time is required for a given well to become shut-in, primarily because the choke valve for a well cannot close instantaneously, meaning that there is some amount of additional flow from the well during the transition from flowing to buildup, as the well shuts in. As mentioned above and as will be evident from the following description, one approach to determining reservoir pressure assumes radial flow into a vertical well from an infinite-acting homogeneous reservoir. Accurate determination of this radial flow requires knowledge of and accounting for this additional flow during the transition to shut-in. It is therefore useful to determine the precise time at which well $W_j$ under analysis becomes completely shut-in.

According to this embodiment of the invention, process 84 determines this precise time at which well $W_j$ is completely shut-in by analyzing downhole pressure measurement data, forwarded thereto by main routine 20, and corresponding to that downhole pressure measurement data acquired from before and after the time at which the change in well operating state was detected (which is somewhat approximate, given the frequency with which that analysis is performed). This determination is based on the assumption that the time derivative of downhole pressure is relatively constant prior to shut-in and changes over time after complete shut-in occurs. Based on this assumption, process 84 according to this preferred embodiment of the invention resolves the first point in time at which this derivative begins changing with time, and returns this point in time as the shut-in time. As known in the art, this point in time is indicated by the time at which downhole pressure begins to increase, after which the rate of this increase immediately falls off. Pressure and other measurement data at times prior to the determined shut-in time are considered to be indicative of the transient behavior as the well is shutting-in.

Figure 10:
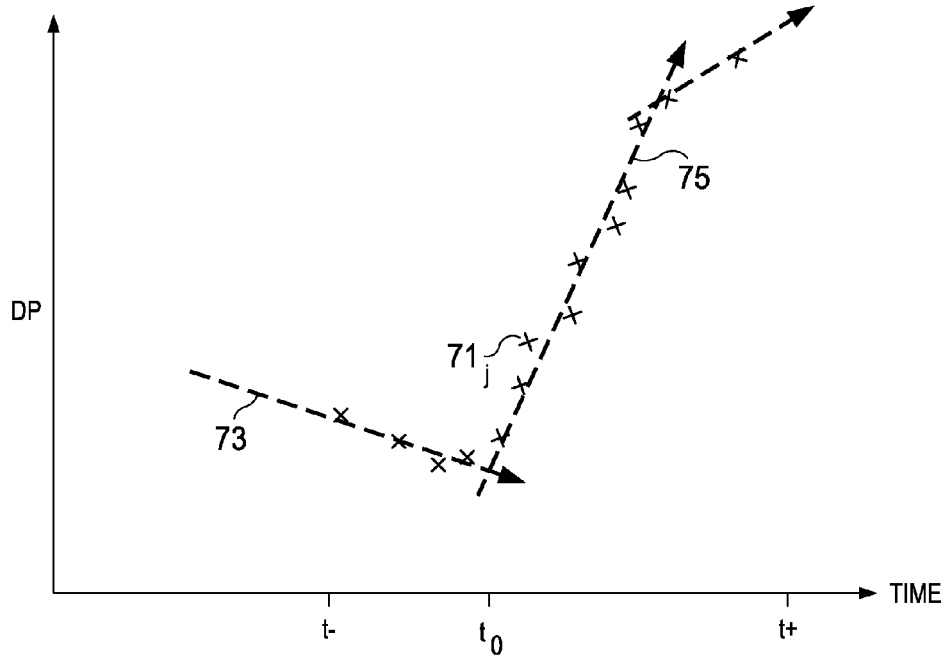
FIG. 10 is a plot illustrating the operation of determining a precise shut-in time for a well, in the method of FIG. 5 and according to that embodiment of the invention.

An example of the determination of the shut-in time in process 84, according to an embodiment of the invention, is graphically illustrated in FIG. 10. In this Figure, downhole pressure measurement data points 71 (an example of which is indicated as data point $\mathbf{71}_j$) are shown as plotted as a function of time, the time being "clock time" at or about the point in time at which the change in well operating state is detected. These downhole pressure measurement data points 71, retrieved from database 12 via main routine 20, correspond to measurement data acquired from a time prior to the suspected shut-in time, shown in FIG. 10 as time t−, and extending past that suspected shut-in time, to time t+ in FIG. 10. According to a preferred embodiment of the invention, a linear regression or other conventional curve-fitting algorithm is applied to these data, using conventional numerical analysis techniques known in the art, and time derivatives are calculated at each of a number of selected points, for example at each point in time for which a measurement is available, beginning from the early point in time t−. At least two points are required to derive a derivative at a given point, although more points (e.g., eight points) are preferable because of the inherently noisy nature of derivative calculations.

In the example of FIG. 10, a linear regression 73 effectively applies to data points 71 beginning with early point in time t−, while linear regression 75 applies to later points in time extending to time t+. Time to corresponds to the point in time at which regressions 73, 75, as extrapolated, intersect. These specific regressions 73, 75 can be selected by analyzing the slopes of backward-looking and forward-looking linear regressions at each measurement point, to identify a maximum differential in those slopes. In this example, time $t_0$ is the precise shut-in time result returned by process 84. Upon determination and return of shut-in time $t_0$, process 84 also preferably returns a pressure value $DP_0$ associated with that shut-in time $t_0$; this pressure value $DP_0$ may be either the actual measurement value taken at that time or an interpolated value, depending on whether time $t_0$ corresponds to an actual measurement point and on the nature of data filtering applied to the measurements.

Figure 11A:
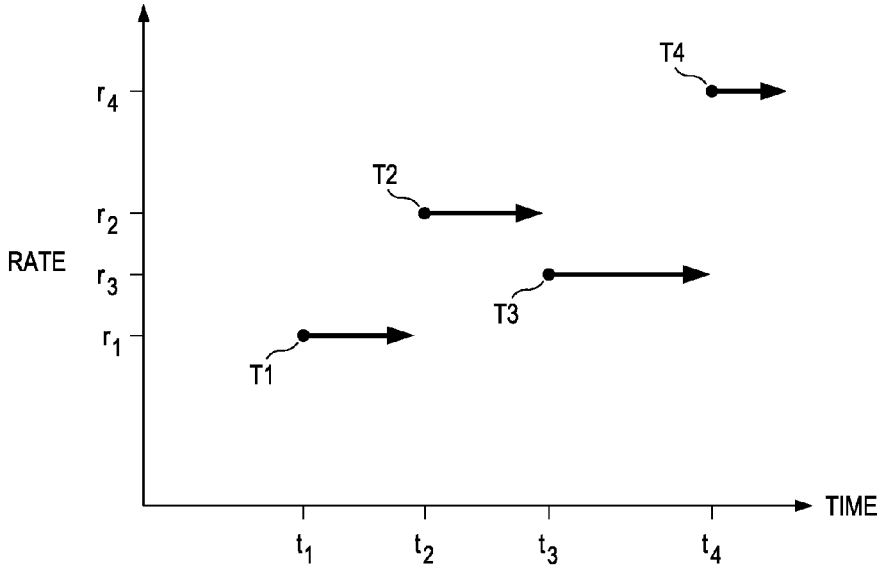
FIGS. 11*a* through 11*c* are plots illustrating examples of the reservoir pressure estimation method of FIG. 9B, and according to that embodiment of the invention.
Figure 11B:
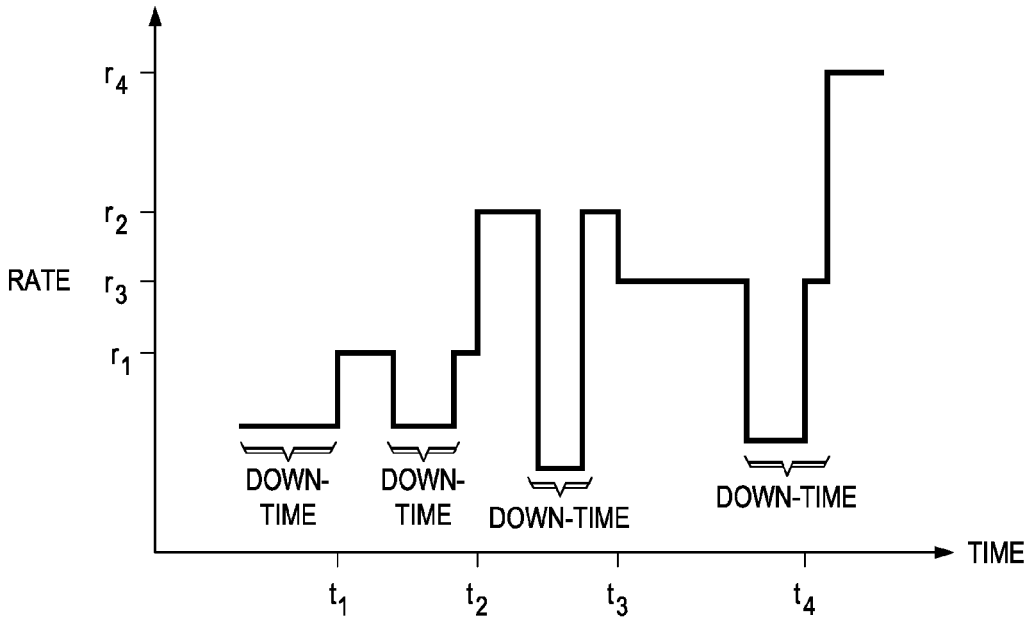
Figure 11C:
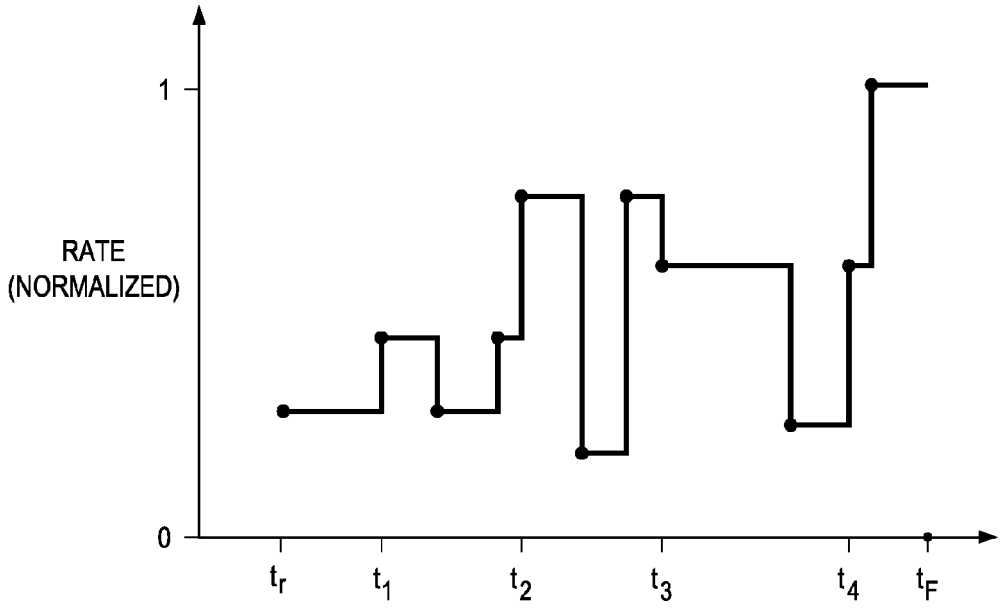

Once the precise shut-in time is derived in process 84, process 40 continues with evaluation of the well rate history for well $W_j$, as may be adjusted for downtimes and other transient events occurring during recent operation, performed by reservoir pressure analysis module 24 in process 86. According to an embodiment of the invention, the well rate history of well $W_j$ is evaluated based on data gathered from the sources of well production test data such as rate and phase determinations from downhole pressure and the like, or well test history and well downtimes, all acquired in process 80. FIGS. 11*a* through 11*c* graphically illustrate the operation of reservoir pressure analysis module 24 in carrying out process 86 according to an embodiment of the invention. Of course, reservoir pressure analysis module 24 will perform process 86 by executing a sequence of instructions in a software routine; it is contemplated that those skilled in the art having reference to this specification will be readily able to implement such a computer program routine, without undue experimentation.

The well rate data obtained from database 12 is typically in the form of flow rates, for each or any of the phases of gas, oil, and water, at a particular date and time. For the example of conventional well tests T1 through T4 for well $W_j$, which were performed on a relatively infrequent basis, as shown in FIG. 11*a*, establish rates (for a given single phase) $r_1$ through $r_4$ at corresponding points in time $t_1$ through $t_4$. For purposes of process 86, reservoir pressure analysis module 24 effectively extends each of these rate measurements $r_1$ through $r_4$ forward in time until the next point in time at which a rate measurement is taken, as illustrated in FIG. 11*a*. This approach may be used for either calculated or measured rates, as mentioned above. If these rate measurements are obtained from a separator (i.e., rate obtained per phase), use of a well model such as the PROSPER well model preferably converts those "separator" measurements to correspond to standard operating conditions, as known in the art.

Those times at which well $W_j$ was shut-in or otherwise not operating (i.e., the "downtimes") are then identified, and then, for each day, the maximum possible rate (the test rate) for that well $W_j$ on that day is adjusted by an amount proportional to the amount of down time for well $W_j$ during that day, as illustrated in FIG. 11*b*. If a downtime period exists prior to an initial test in the rate history (e.g., prior to time $t_1$ in FIG. 11*b*), then the reduced rate is extended back to the beginning of the downtime; conversely, downtime after the last test point is extended to the end of the downtime duration). The rate following a given test is reduced during downtimes between test points (e.g., the rate is reduced from rate $r_1$ for the downtime between times $t_1$ and $t_2$). Downtime that extends across the forward extension times of two tests is reflected by reducing the rates from both tests, as shown in FIG. 11*b* for the downtime containing time $t_4$. This adjustment results in a rate history, for a given phase, such as that shown in FIG. 11*b*. The accuracy of the reservoir pressure determined according to this embodiment of the invention depends on the quality and accuracy of the rate history, considering that this rate history is used to remove event-related pressure transients (e.g., such as may be caused by brief shut-in periods) from the pressure history at and near well $W_j$. Adjustment of the rate history to account for these downtime periods in this manner thus greatly improves the accuracy of the reservoir pressure derived according to this embodiment of the invention.

Finally, in process 86, the rate history for each phase is extrapolated as necessary to the specified initial and final well flowing times $t_I$, $t_F$, respectively, as shown in FIG. 11*c*. Furthermore, the rates $r_1$ through $r_4$ are preferably normalized to the final flowing rate, also as shown in FIG. 11*c*. As mentioned above, the rate history processed according to FIGS. 11*a* through 11*c* correspond to the rate history for one of the possible phases (oil, gas, water). Rate histories are similarly developed, in process 86, for the other phases from the same well $W_j$ over the same time period.

Upon evaluation of the rate history in process 86, this rate history and other known parameters of well $W_j$ are used, in process 88, to analyze the pseudo-radial flow segment of the pressure buildup (for the shut-in case), from which the reservoir pressure and other parameters regarding well $W_j$ are calculated according to this embodiment of the invention. It is contemplated that additional processing of the rate history may be applied, prior to process 88, in order to assist in this pseudo-radial flow analysis.

For example, reservoir pressure analysis module 24 preferably applies the well-known Superposition Function to the well rate history, in process 88. As fundamental in the art, the Superposition Function analysis considers a rate history with time-varying flow rates, such as that illustrated in FIG. 11*c*, as the superposition of multiple constant flow rates. This allows the overall solution for a given well $W_j$ over time to be broken up into several constant rate problems, rendering the solution substantially easier than would be a solution of the more complex variable flow rate problem. In addition, calculations based on the corresponding PROSPER or other model for well $W_j$, on rate and phase functional equations previously derived by a user, on user-specified rate and phase values, and rate and phase values from other modeling or data sources, may also be incorporated. In the case of gas wells, the well rate history produced in process 86 may be processed by way of a pseudo-pressure transform, to account for changes in gas properties with pressure, based on gas PVT data, gas viscosities and densities, compressibility or volume factors, and the like, all of which depend on pressure at a given reservoir temperature. Such additional gas factors can also be based on stored data or calculated, by well modeling module 22, from equations of state or empirical correlations, depending on the nature of the available data.

Figure 12:
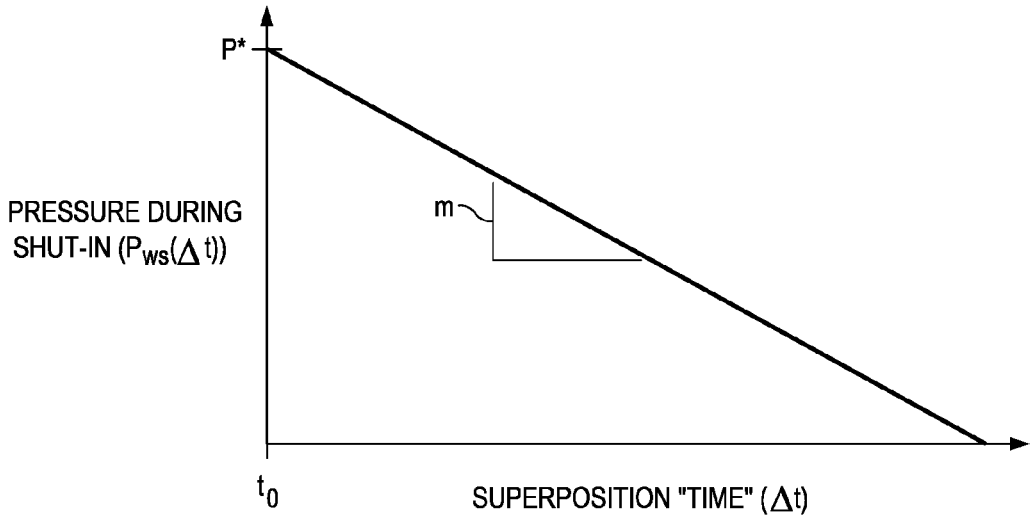
FIG. 12 is a plot illustrating the superposition function used in the method of FIG. 9B, according to that embodiment of the invention, to derive reservoir pressure.

As known in the art, the Superposition Function transforms the downhole pressure measurements over time, beginning prior to the shut-in time $t_0$ and continuing after this shut-in time for a selected period, into a plot of downhole pressure over "superposition" time $\Delta t$ following the shut-in time $t_0$. In a situation in which the radial flow assumption holds, and in which shut-in occurs at time $t_0$ following an arbitrary rate history with n rate changes prior to shut-in, the downhole pressure $P_{ws}(\Delta t)$ appears as a linear relationship. A well known form for applying superposition is:

$$p_{ws}(\Delta t) = P^* - 162.6\frac{B\mu}{kh}\sum_{i=1}^{n}(q_i - q_{i-1})\log(\Delta t + t_0 - t_i)$$

where B and $\mu$ are the well-known fluid properties of formation volume factor and viscosity, respectively, and where kh is the permeability-thickness product. The term $q_i$ refers to the flow rate from well $W_j$ following the $i^{th}$ rate change. As evident from these expressions, a linear regression or line-fit of the transformed pressure measurements over superposition time will return an intercept value P* and a slope, assuming that the radial flow assumption is valid. FIG. 12 illustrates such a regression line, in which the extrapolated pressure value intercept P* at time $t_0$ and the slope m can be readily calculated. In process 88, therefore, reservoir pressure analysis module 24 is executed over the post-shut-in data acquired in process 60, along with the rate history data acquired in process 80, to return an extrapolated downhole pressure value P* and a slope value m. As mentioned above, the extrapolated downhole pressure value P* can be further processed to arrive at an estimate of the reservoir pressure, for example by way of the Dietz corrections and the like; alternatively, changes in this extrapolated downhole pressure value P* relative to previous instances of process 88 and based on an extrinsic or characterized absolute reservoir pressure value, can be applied to derive a reservoir pressure estimate. It is contemplated that the numerical calculations carried out in connection with process 88 will be readily apparent to those skilled in the art having reference to this specification.

Process 88, according to this embodiment of the invention, also can be used to derive estimates of parameter values such as permeability and skin factor. As noted above, the Superposition Function analysis can be used to provide a value for permeability-thickness, from the slope of the superposition pressure line. As known in the art, permeability-thickness corresponds to the product of formation permeability k and the thickness h of the producing formation. It is contemplated that reservoir pressure analysis module 24 can readily derive an estimate of formation permeability k from the slope of the superposition plot and extrinsic knowledge of the formation thickness h, for example from well logs or other measurements.

According to this embodiment of the invention, also in process 88, the downhole pressure data over time (including over "superposition" time) are transformed into a derivative-plot, to provide estimates of permeability and skin factor. Preferably, this transform into derivative values is applied to the rates and pressures over superposition time, as derived in connection with the Superposition Function analysis described above. According to this embodiment of the invention, the derivative at each point in superposition time is calculated as a weighted average of a forward and backward derivative, preferably a weighted average of forward and backward slopes of linear regressions applied to the pressure values returned by the Superposition Function processing described above.

Figure 13:
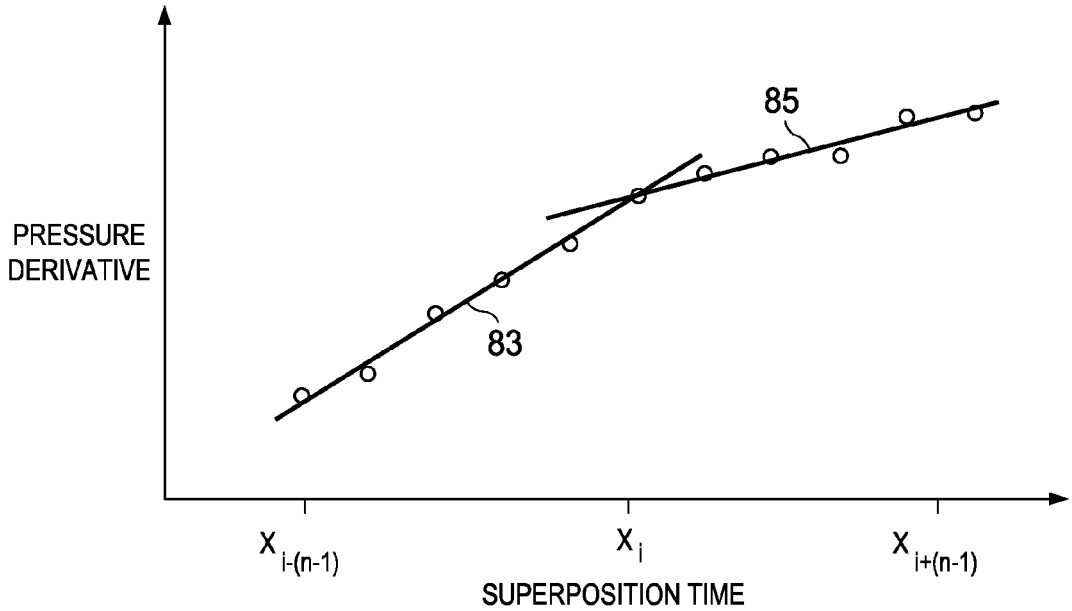
FIG. 13 is a plot illustrating an example of the determination of pressure derivatives over superposition time in the reservoir pressure estimation method of FIG. 9, and according to that embodiment of the invention.

FIG. 13 illustrates a preferred approach to determining a derivative of pressure at a point $x_i$ in superposition time. In the example of FIG. 13, a backward-looking derivative $m^-$ is calculated for regression 83 applied to n points (n=6, in this example) including point $x_i$ and the n−1 preceding points in superposition time, and a forward-looking derivative $m^+$ is calculated for the n points including point $x_i$ and the n−1 following points in superposition time. The number of points n involved in each regression is reduced at the beginning and end of the dataset. The derivative $m_i$ at point $x_i$ is then calculated as an average:

$$m_i = \frac{m^+(x_{i+(n-1)} - x_i) - m^-(x_i - x_{i-(n-1)})}{x_{i+(n-1)} - x_{i-(n-1)}}$$

The weighting of this average is applied based on the duration, in superposition time, of the respective regressions. This determination of the pressure derivative is repeated for each operative point in the superposition well history.

Once the sequence of pressure derivatives is determined, the effect of wellbore storage is preferably determined, at least in the case in which well $W_j$ is an oil well. This wellbore storage is calculated from a unit slope line fit through the transient pressure data leading up to complete shut-in, on a log-log scale, versus time. Because, in theory, this slope should decrease over time, the wellbore storage determination is based on those measurements up to such time as the decrease in the rate of change of pressure is significant.

As evident from FIG. 8, process 40 also preferably derives estimates of permeability of the formations surrounding well $W_j$, and of the skin, also known as skin factor. In an aspect of this invention, skin is comprised of mechanical skin, friction skin, and non-Darcy skin, which collectively make up total skin of well $W_j$. for example. Generally, the term skin effect may be used and is defined as a dimensionless quantity that accounts for the deviation of the real world from the ideal Darcy solution. In an aspect of this invention, skin S is a zone extending a small distance ("ra") into the reservoir that creates a constant pressure drop per unit of the flow-rate ("q"). Skin can be expressed by the following equation:

$$\Delta p(\Delta t) \approx p_d(\Delta t) = 162.6\frac{\mu B}{kh}[\log(\Delta t) + C + S]$$

wherein the solution is:

$$\Delta p(\Delta t) = 141.2\frac{\mu q B}{kh}S.$$

By way of further background, in an aspect of the invention, the term skin factor means and refers to a numerical value used to analytically model the difference from the pressure drop predicted by Darcy's law due to skin, or in other words, the degree of reduction in permeability immediately proximal to the wellbore, for example. In an aspect, the term "total skin" is equal to summation of the mechanical skin and turbulent skin, for example. In an aspect of this invention, the term mechanical skin means and refers to a non-conventional well perforation skin factor, for example. In an aspect of this invention, the total skin effect can have both a laminar and turbulent component, expressed as S'=S+Dq, wherein S is the laminar skin factor due to change in permeability k, and wherein Dq is the turbulent skin due to high fluid velocity. In addition, the term skin effect may be used and is defined as a dimensionless quantity that accounts for the deviation of the real world from the ideal Darcy solution.

Following this transformation into derivative values, reservoir pressure analysis module 24 numerically analyzes the transformed derivative values, in a manner illustrated by the log-log scale plots illustrated in FIG. 8, in which "delta-P" curve 70 corresponds to a measure of downhole pressure over time ("superposition" time after shut-in time $t_0$), normalized by rate, and in which "derivative" curve 72 corresponds to the time-derivative of downhole pressure over time. These curves 70, 72 lend insight into important parameters regarding well $W_j$, as known in the art. The "straight-line" portion of curve 72, illustrated as region 74 in FIG. 8, provides a measure of permeability-thickness kh; this constant time-derivative value corresponds to the slope m in the superposition plot of FIG. 12 discussed above. Secondly, the distance d between straight-line region 74 of derivative curve 72 and the relatively straight portion of delta-P curve 70 is proportional to the skin factor at well $W_j$. It is contemplated that reservoir pressure analysis module 24 can include the appropriate numerical analysis instructions and routines by way of which values for the parameters of permeability-thickness (and thus permeability itself) and skin factor can be readily derived in process 88.

In addition, also as known in the art, the shape of derivative curve 72 for a given well is characteristic of physical properties of the reservoir. Accordingly, it is also contemplated that reservoir pressure analysis module 24, in process 88 or otherwise, can numerically compare the characteristic shape of derivative curve 72 based on measurement data acquired for the current shut-in event or other well operating state change, with the characteristic shape of this curve from previous events, to detect a change in reservoir properties.

According to this preferred embodiment of the invention, reservoir pressure analysis module 24 is also capable of deriving measurements of each of the components of the overall skin factor, in an automated manner and based on the downhole pressure and other measurements acquired from well $W_j$. This knowledge of the components of the skin factor provides visibility into the physical causes of changes in the skin factor, and thus provides insight into the most beneficial corrective action applied to the well. For example, it is contemplated that a "non-Darcy" skin factor component can be calculated, in this process 88, as the product of the final flow rate $q_n$ times a factor proportional to a non-Darcy flow constant D, and a frictional skin factor component can be calculated from the average slope of the superposition plot divided into a measure of an assumed or characterized pressure differential due to friction at the wellbore. A mechanical skin factor component can thus be calculated as the overall skin factor less the "non-Darcy" and frictional skin factor components so calculated.

These measures of the reservoir pressure, permeability, and skin factor are all preferably quality checked, for example by way of a superposition or derivative plot, in the known manner, by reservoir pressure analysis module 24, also within process 40.

Upon completion of process 40, reservoir pressure analysis module 24 cooperates with main routine 20 to communicate these raw results to database 12, and the results can be used to update well modeling module 22 in process 42. The analysis at this point in the process is referred to as "raw", because its results have not yet been verified or modified by an expert or other user, for example a human expert. Accordingly, in an embodiment of process 44, main routine 20 notifies the responsible human expert that an event has occurred at well $W_j$ that has generated a new raw reservoir pressure analysis for well $W_j$. It is contemplated that this responsible human expert will be one or more reservoir engineers who have been identified in advance as having responsibility for the management of the reservoir containing well $W_j$. Various approaches may be used to perform notification process 44, for example. In an embodiment, a process trigger causes a notification which is transmitted to a desired location or user. In an embodiment, the notification is visual or auditory. In another embodiment, the notification is vibrational, such as a signal sent to a pager, mobile phone, or other electronic device. In further aspect, the notification is a phone call, an email, a text message, or an automated message which is transmitted to the user. In an embodiment, an email may be automatically sent to the responsible reservoir engineers, with a network link to the new raw reservoir pressure analysis data in data base 12.

In any event, according to an embodiment of the invention, a human engineer is notified of the change in the operating state of the well, after the determination that sufficient measurement data were acquired to generate an estimate of the reservoir pressure, and perhaps other parameters such as permeability, skin factor, and the like. This notification may also include an estimate of the reservoir pressure and such other parameters that may be included, as described above. The operation of the method and system according to this embodiment of the invention thus spares the human engineer from having to pore through a vast amount of data in order to identify potential shut-in or drawdown events, over the hundreds of wells that may be operating in a given reservoir, and spares this engineer from the substantial tedious work necessary to subjectively analyze that data to derive a reservoir pressure estimate.

Upon notification, one or more of the responsible users is expected to view the new raw reservoir pressure analysis data derived in this instance of process 40, and to either verify those pressure analysis data, modify the results based on other knowledge, or to reject the solution and results entirely. For example, it is contemplated that an experienced user, such as a reservoir engineer or petroleum engineer, can determine, from his or her knowledge about the reservoir, whether the raw estimate P* of reservoir pressure is a good indication of reservoir pressure, and if not, can manually adjust or correct the raw estimate to more closely match the "true" reservoir pressure. In addition, the raw estimate P* will be generated at the depth of the downhole pressure sensor PT; accordingly, it is contemplated that the reservoir engineer may apply a correction factor to estimate P* to a datum depth, if desired. Such corrections may also result in recalculation of permeability and skin factor, depending on the model being applied.

Well modeling module 22 thus executes decision 45 to determine whether the raw pressure estimate was verified by the reservoir engineer. If the raw pressure estimate for well $W_j$ is not verified, but instead is modified by the engineer (decision 45 is NO), well modeling module 22 executes process 46 to update the reservoir pressure, permeability, and skin factor for well $W_j$ based on these inputs. In an aspect, the inputs can extend the duration of the data sets, if desired. For example, as described above, FIG. 9A shows the control parameters that can be used to determine the dataset that is acquired. FIG. 9A shows that prior to performing an analysis, each well needs to have access to configured parameters that control the behaviour of the system, these parameters can be fine tuned to improve the quality of the results (different for each well). Fine tuning is the process of adjusting for the individual well behaviour to make them more specific for each well. For example, the minimum shut in period can be adjusted if it is found that radial flow does not occur/is not seen within the currently predetermined/configured value. Further, a certain shut-in period (Minimum Shut-In Duration as shown in FIG. 9A) will have to elapse before it is appropriate to analyse the data for dynamic properties.

Once a Shut-In event has been detected, and the well has been shut-in for its minimum period, the Prior Rate Data is gathered for a configurable period. Prior-rate information does not have to contain as much data as the shut-in information—so it is acquired at a lower density (higher time interval between points) if the user wishes to choose such configuration. In order to detect the shut-in event correctly it is necessary to acquire higher density data immediately prior to the event as well as during the event. In this example, one hour of high density data is acquired for this purpose.

During validation it is possible for the user to "extend" the analysis period up to a maximum period (configurable as Maximum Shut-In Period, as shown in FIG. 9A). The user must request this data extension—it is not done automatically. Once the data has been extended a new analysis is done, and the previous one discarded. If an event is submitted in Manual mode, the data is always acquired for the maximum available period (it acquires as much data as it can).

Figure 5:
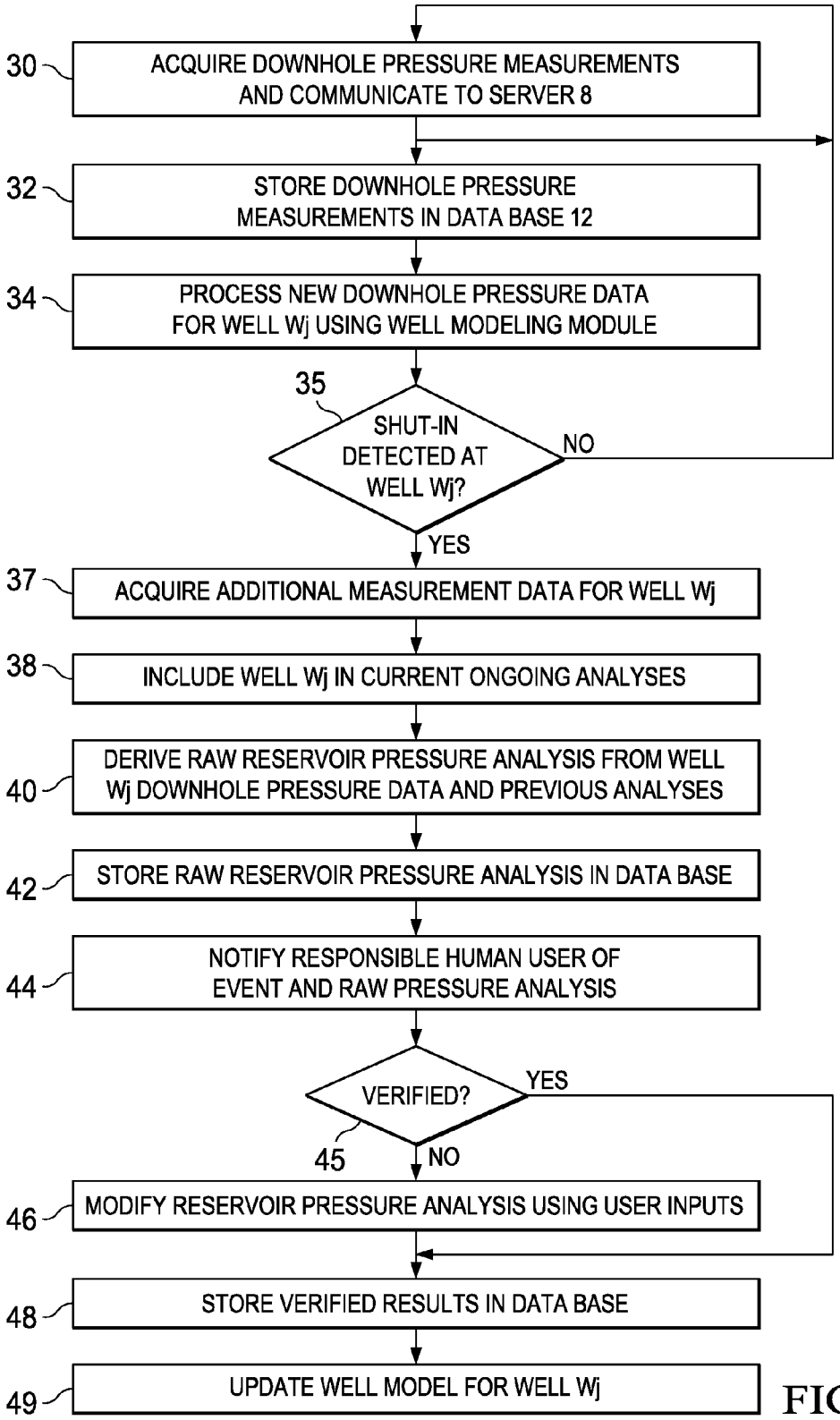
FIG. 5 is a flow diagram illustrating the operation of an automated analysis method according to an embodiment of the invention.

Following this updating of process 46 (as shown in FIG. 5), or if the raw pressure estimate results are verified by the user (decision 45 is YES), well modeling module 22 cooperates with main routine 20 to store these verified or modified results in data base 12. In addition, it is contemplated that the results of this process, as user-verified or modified, can then be applied to update the current PROSPER, PIPESIM, WELLFLOW, or other model of well $W_j$, in process 49 as executed by well modeling module 22. In this manner, the accuracy of the well model is updated based on the most current expert-verified information, resulting from the shut-in or fall-off event occurring for well $W_j$ and processed in the manner described in connection with FIG. 5 according to this embodiment of the invention.

This updating of the well model in process 49 permits the production personnel, or other users, to make various decisions regarding the operation of well $W_j$ itself. As known in the art, the parameters of permeability and skin factor at a wellbore are important indicators of whether particular well management actions ought to be taken. For example, if the skin factor indicates that the near-wellbore formation has become unduly packed such that production fluids cannot pass, actions such as fracturing of the wellbore walls can be undertaken. These and other well management actions can be taken based on the updated reservoir pressure, permeability, and skin factor parameters produced by embodiments of the invention described herein, and in an automated manner during normal operations (i.e., without requiring a conventional well test).

It is contemplated that the downhole pressure measurements so acquired, and also the parameters of reservoir pressure, permeability, skin factor, and skin factor components obtained from those measurements, according to an embodiment of the invention, can also be linked to other reservoir management tools. For example, it is contemplated that this preferred embodiment of the invention can be linked to existing "early-time" reservoir tools to determine the onset of two-phase flow from a reservoir that initially exhibits only a single phase. In addition, the reservoir pressure, permeability, and skin factor parameters determined according to this invention can be linked to larger-scale engineering and geosciences software applications that carry out reservoir performance predictions, and also economic modeling of the production field.

Referring back to FIG. 5, following the updating of the model for well $W_j$ in process 49, the updated and modified reservoir pressure at the location of well $W_j$ according to this preferred embodiment of the invention can also be communicated to and merged into an overall model of the reservoir containing well $W_j$. As known in the art, the parameters of reservoir pressure and permeability provide important information in the management of a reservoir, especially when considering reservoir management decisions such as whether to shut-in a well, whether to add an injection well or undertake other secondary or tertiary operations in the vicinity of a well, and indeed whether to add another producing well as well as the possible location of such another well.

According to embodiments of this invention, therefore, important benefits in the management, design, and operation of modern oil and gas wells and production fields are attained. Normal events in the operation of a producing or injecting well are detected, from downhole pressure measurements obtained from those wells, and data is automatically acquired and processed to provide reservoir pressure estimates from these normal events. This system and method enables these estimates to be obtained, in raw form, without the intervention of an engineer or other user. Because this invention frees human users from poring through massive downhole pressure measurements, and notifies the user upon a reasonable estimate having been made from a normal well event, great improvements in the efficiency of the expertise of the user are attained. Further efficiency can be gained, as a result of this invention, by using normal shut-in events to determine reservoir pressure, permeability, and skin factor; it is contemplated that this system and method can take the place of conventional well tests, thus avoiding the cost and effort, as well as lost production, that are consumed by such well tests. And the linkage of the system and method of embodiments of the invention to other reservoir management tools improves the visibility of those other tools into the reservoir, and ultimately can improve the accuracy of reservoir management decisions.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of estimating reservoir pressure in a subsurface hydrocarbon reservoir, comprising:

receiving, during normal operations of the well producing hydrocarbons, data corresponding to pressure measurements at a wellbore of a well, corresponding to temperature measurements at the wellbore of the well, corresponding to rate history of flow rates for each or any of phases of gas, oil, and water at the well, and corresponding to a state of valves in the wellbore of the well;

applying, by a computer, the received data to a model of the well to determine an operating mode of the well over time, wherein the model determines the operating mode based on the pressure measurements, the temperature measurements, and the state of the valves and wherein the operating mode comprises one of steady-state shut-in, steady-state producing, steady-state injecting, transient shutting-in, transient start-up, and slugging;

applying, by the computer, the rate history to remove event-related pressure transients from a pressure history at or near the well;

determining, by the computer during normal operations of the well producing hydrocarbons, a change in the determined operating mode of the well that indicates a change in the flow at the well, wherein the change in the determined operating mode is determined by the application of the received data and the rate history to remove event-related pressure transients from a pressure history at or near the well to the model;

upon the change in the determined operating mode of the well that indicates the change in the flow at the well, receiving additional data corresponding to pressure measurements at the wellbore of the well over a transient period following the change in the determined operating mode until a steady state is reached or upon another change in the determined operating mode;

determining, by the computer, an estimate of reservoir pressure at the well from the received additional data corresponding to the pressure measurements at the wellbore of the well over the transient period following a change to transient shut-in and/or shut-in mode; and notifying a user of the change in operating mode at the well and of the estimated reservoir pressure.

2. The method of claim 1, wherein the notifying comprises transmitting a notification to a user.

3. The method of claim 1, further comprising:

receiving inputs from the user corresponding to a modification of the estimated reservoir pressure; and storing a modified value of estimated reservoir pressure for the well based on the inputs from the human user.

4. The method of claim 3, further comprising:

modifying the model of the well using the modified value of estimated reservoir pressure.

5. The method of claim 1, wherein receiving additional data comprises:

receiving additional data from pressure measurements until a termination criterion is met; and wherein the method further comprises:

determining, by the computer, whether sufficient data have been received to determine the estimate of reservoir pressure.

6. The method of claim 5, wherein the termination criterion comprises detecting a constant time rate of change of pressure in the received data.

7. The method of claim 5, wherein the termination criterion comprises determining another change in the operating mode of the well.

8. The method of claim 1, wherein the pressure measurements comprise downhole pressure measurements obtained at a depth along the wellbore from a surface of a planet, wherein the planet is the earth.

9. The method of claim 8, wherein the change in operating mode corresponds to a change from a producing operating mode to a shut-in operating mode.

10. The method of claim 1, wherein the pressure measurements comprise surface pressure measurements obtained from the wellbore;

and wherein the change in operating mode at the well corresponds to a change from an injecting operating mode to a shut-in operating mode.

11. The method of claim 1, further comprising:

modifying the model of the well using the estimated reservoir pressure.

12. The method of claim 1, wherein the change in operating state corresponds to a shut-in of the well;

and wherein the method further comprises:

determining, from data corresponding to pressure measurements for the well, a shut-in time of the well;

and wherein determining an estimate of reservoir pressure comprises:

calculating a regression of data corresponding to pressure measurements to produce an intercept value of pressure at the determined shut-in time.

13. The method of claim 12, further comprising:

retrieving data corresponding to pressure measurements, production rates, and well down times over time prior to the shut-in time of the well; and evaluating a well rate history from the retrieved data;

wherein the calculating step comprises:

transforming the retrieved data into pressure over superposition time; and calculating a regression of the transformed pressure data over superposition time to produce the intercept value.

14. The method of claim 1, wherein determining an estimate comprises determining an estimate of a variation in reservoir pressure from a previous estimate.

15. The method of claim 1, the method further comprising determining an estimate of permeability of the well.

16. The method of claim 1, the method further comprising determining an estimate of skin factor at the well.

17. The method of claim 16, the method further comprising determining an estimate of at least one skin factor component at the well.

18. Previously Presented) The method of claim 16, the method further comprising:

receiving inputs from a user corresponding to a modification of the estimated reservoir pressure;

storing a modified value of estimated reservoir pressure for the well based on the inputs from the user; and recalculating estimates of permeability and skin factor using the modified value of estimated reservoir pressure.

19. A computer system, comprising:

a data interface for receiving measurement data corresponding to temperature and pressure measurements from at least one hydrocarbon well;

a memory resource;

a network interface for presenting and receiving communication signals to a network accessible to users;

one or more central processing units for executing program instructions; and program memory, coupled to the central processing unit, for storing a computer program including program instructions that, when executed by the one or more central processing units, cause the computer system to perform a sequence of operations for estimating reservoir pressure for a reservoir at which the at least one hydrocarbon well is located, the sequence of operations comprising:

receiving, during normal operations of the at least one hydrocarbon well producing hydrocarbons, data from the data interface corresponding to pressure measurements from sensors at a wellbore of the at least one hydrocarbon well, corresponding to temperature measurements at the wellbore of the at least one hydrocarbon well, corresponding to rate history of flow rates for each or any of phases of gas, oil, and water at the well, and corresponding to a state of valves in the wellbore of the at least one hydrocarbon well;

applying the received data to a model of the at least one hydrocarbon well to determine an operating mode of the at least one hydrocarbon well over time, wherein the model determines the operating mode based on the pressure measurements, the temperature measurements, and the state of the valves and wherein the operating mode comprises one of steady-state shut-in, steady-state producing, steady-state injecting, transient shutting-in, transient start-up, and slugging;

determining, during normal operations of the at least one hydrocarbon well producing hydrocarbons, a change in the determined operating mode of the at least one hydrocarbon well that indicates a change in the flow at the at least one hydrocarbon well, wherein the change in the determined operating mode is determined by the application of the received data and the rate history to remove event-related pressure transients from a pressure history at or near the well to the model;

upon the change in the determined operating mode of the at least one hydrocarbon well that indicates the change in the flow at the at least one hydrocarbon well, receiving additional data at the data interface corresponding to pressure measurements at the wellbore of the at least one hydrocarbon well over a transient period following the change in the determined operating mode until a steady state is reached or upon another change in the determined operating mode;

determining an estimate of reservoir pressure at the at least one hydrocarbon well from the received additional data corresponding to the pressure measurements at the wellbore of the at least one hydrocarbon well over the transient period following a change to transient shut-in and/or shut-in operating mode; and notifying a user of the change in operating mode at the at least one hydrocarbon well and of the estimated reservoir pressure, by way of communications signals transmitted over the network.

20. The system of claim 19, wherein the computer system comprises a plurality of servers, each server comprising one of the central processing units, and each server having a network interface for communicating with one another over the network.

21. The system of claim 19, wherein the sequence of operations further comprises:

receiving, over the network, inputs from a user corresponding to a modification of the estimated reservoir pressure; and storing a modified value of estimated reservoir pressure for the at least one hydrocarbon well based on the inputs from the user.

22. The system of claim 19, wherein the operation of receiving additional data receives additional data from pressure measurements until a termination criterion is met;

and wherein the sequence of operations further comprises:

determining whether sufficient data has been received to determine the estimate of reservoir pressure.

23. The system of claim 22, wherein the termination criterion comprises detecting a constant time rate of change of pressure in the received data.

24. The system of claim 22, wherein the termination criterion comprises determining another change in the operating mode of the at least one hydrocarbon well.

25. The system of claim 19, wherein the change in operating state corresponds to a shut-in of the at least one hydrocarbon well;

wherein the sequence of operations further comprises:

determining, from data corresponding to pressure measurements for the well, a shut-in time of the at least one hydrocarbon well;

and wherein determining an estimate of reservoir pressure comprises:

calculating a regression of data corresponding to pressure measurements to produce an intercept value of pressure at the determined shut-in time.

26. The system of claim 25, wherein the sequence of operations further comprises:

retrieving data, at the data interface, corresponding to pressure measurements, production rates, and well down times over time prior to the shut-in time of the at least one hydrocarbon well; and evaluating a well rate history from the retrieved data;

wherein the calculating operation comprises:

transforming the retrieved data into pressure over superposition time; and calculating a regression of the transformed pressure data over superposition time to produce the intercept value.

27. The system of claim 19, wherein the determining operation also determines estimates of permeability of the at least one hydrocarbon well and of skin factor at the at least one hydrocarbon well.

28. The system of claim 27, wherein the sequence of operations further comprises:

receiving, over the network, inputs from the user corresponding to a modification of the estimated reservoir pressure;

storing a modified value of estimated reservoir pressure for the at least one hydrocarbon well based on the inputs from the user; and recalculating estimates of permeability and skin factor using the modified value of estimated reservoir pressure.

29. The system of claim 19, wherein the determining operation also determines an estimate of at least one skin factor component at the at least one hydrocarbon well.

30. A non-transitory computer-readable medium storing a computer program that, when executed on a computer system, causes the computer system to perform a sequence of operations for estimating reservoir pressure for a reservoir at which a well is located, the sequence of operations comprising:

receiving, during normal operations of the well producing hydrocarbons, data corresponding to pressure measurements from sensors at a wellbore of the well, corresponding to temperature measurements at the wellbore of the well, corresponding to rate history of flow rates for each or any of phases of gas, oil, and water at the well, and corresponding to a state of valves in the wellbore of the well;

applying the received data to a model of the well to determine an operating mode of the well over time, wherein the model determines the operating mode based on the pressure measurements, the temperature measurements, and the state of the valves and wherein the operating mode comprises one of steady-state shut-in, steady-state producing, steady-state injecting, transient shutting-in, transient start-up, and slugging;

determining, during normal operations of the well producing hydrocarbons, a change in the determined operating mode of the well that indicates a change in the flow at the well, wherein the change in the determined operating mode is determined by the application of the received data and the rate history to remove event-related pressure transients from a pressure history at or near the well to the model;

upon the change in the determined operating mode of the well that indicates the change in the flow at the well, receiving additional data corresponding to pressure measurements at the wellbore of the well over a transient period following the change in the determined operating mode until a steady state is reached or upon another change in the determined operating mode;

determining an estimate of reservoir pressure at the well from the received additional data corresponding to the pressure measurements at the wellbore of the well over the transient period following a change to transient shut-in and/or shut-in mode; and notifying a user of the change in operating mode at the well and of the estimated reservoir pressure.

31. The computer-readable medium of claim 30, wherein the sequence of operations further comprises:

receiving, over a network, inputs from a human user corresponding to a modification of the estimated reservoir pressure; and storing a modified value of estimated reservoir pressure for the well based on the inputs from the human user.

32. The computer-readable medium of claim 30, wherein the operation of receiving additional data receives additional data from pressure measurements until a termination criterion is met;

and wherein the sequence of operations further comprises:

determining whether sufficient data has been received to determine the estimate of reservoir pressure.

33. The computer-readable medium of claim 30, wherein the change in operating state corresponds to a shut-in of the well;

wherein the sequence of operations further comprises:

determining, from data corresponding to pressure measurements for the well, a shut-in time of the well;

and wherein the operation of determining an estimate of reservoir pressure comprises:

calculating a regression of data corresponding to pressure measurements to produce an intercept value of pressure at the determined shut-in time.

34. The computer-readable medium of claim 33, wherein the sequence of operations further comprises:

retrieving data, at the data interface, corresponding to pressure measurements, production rates, and well down times over time prior to the shut-in time of the well; and evaluating a well rate history from the retrieved data;

wherein the calculating operation comprises:

transforming the retrieved data into pressure over superposition time; and calculating a regression of the transformed pressure data over superposition time to produce the intercept value.

35. The computer-readable medium of claim 30, wherein the determining operation also determines estimates of permeability of the well and of skin factor at the well.

36. The computer-readable medium of claim 35, wherein the determining operation also determines an estimate of at least one skin factor component at the well.

37. The computer-readable medium of claim 35, wherein the sequence of operations further comprises:

receiving, over the network, inputs from the user corresponding to a modification of the estimated reservoir pressure;

storing a modified value of estimated reservoir pressure for the well based on the inputs from the user; and recalculating estimates of permeability and skin factor using the modified value of estimated reservoir pressure.

* * * * *